US012723772B2

(12) United States Patent
Liu et al.

(10) Patent No.: US 12,723,772 B2
(45) Date of Patent: Sep. 1, 2026

(54) AIR CONDITIONING DEVICE AND METHOD WITH VAPOR PRESSURE DEFICIT CONTROL

(71) Applicant: AC Infinity Inc., City of Industry, CA (US)

(72) Inventors: Jimmy Liu, Brea, CA (US); Daniel Yu Hsu, Upland, CA (US); Wilbur Y. Cheng, Chino Hills, CA (US); Wei Ying Shao, Alhambra, CA (US)

(73) Assignee: AC Infinity Inc., City of Industry, CA (US)

( * ) Notice: Subject to any disclaimer, the term of this patent is extended or adjusted under 35 U.S.C. 154(b) by 144 days.

(21) Appl. No.: 18/654,482

(22) Filed: May 3, 2024

(65) Prior Publication Data

US 2025/0341333 A1 Nov. 6, 2025

(51) Int. Cl.
*F24F 11/65* (2018.01)
*F24F 1/028* (2019.01)
(Continued)

(52) U.S. Cl.
CPC ..... *F24F 11/65* (2018.01); *F24F 1/028* (2019.02); *F24F 11/80* (2018.01); *F24F 2110/10* (2018.01); *F24F 2110/20* (2018.01)

(58) Field of Classification Search
CPC ..... F24F 11/65; F24F 11/80; F24F 2110/10; F24F 2110/20; F24F 1/028; Y02A 40/25;
(Continued)

(56) References Cited

U.S. PATENT DOCUMENTS 2,719,410 A * 10/1955 Deering ..... F24F 1/04 62/262
11,096,337 B1 * 8/2021 Wilson ..... A01G 9/246
(Continued)

OTHER PUBLICATIONS

The Ultimate Vapor Pressure Deficit (VDP) Guide, Peter Koverda, https://pulsegrow.com/blogs/learn/vpd, Feb. 12, 2020. (Year: 2020).*
(Continued)

*Primary Examiner* — Marc E Norman
(74) *Attorney, Agent, or Firm* — NKL Law; Allen Xue

(57) ABSTRACT

An air conditioning device with VPD control for indoor residential cannabis cultivation is provided. The air conditioning device with VPD control includes: a control module with a processing unit, a display screen and an IO interface; a cooling unit for providing cold air in response to a cooling unit control signal from the control module; a fan for circulating cold air in response to a fan control signal from the control module; and a temperature-humidity sensor for sensing an environmental temperature value T and an environmental relative humidity value RH within an indoor cannabis cultivation environment, the environmental temperature value $T_{ENV}$ and the environmental relative humidity value $RH_{ENV}$ are transmitted to the control module in real time, and a leaf VPD value $VPD_{LEAF}$ is calculated from the environmental temperature value $T_{ENV}$ and the environmental relative humidity value $RH_{ENV}$ by the processing unit of the control module.

14 Claims, 15 Drawing Sheets

(51) Int. Cl.
*F24F 11/80* (2018.01)
*F24F 110/10* (2018.01)
*F24F 110/20* (2018.01)

(58) Field of Classification Search
CPC ..... A01G 9/24; A01G 9/246; A01G 31/008; A01G 31/011
See application file for complete search history.

(56) References Cited

U.S. PATENT DOCUMENTS

| | | | | |
|---|---|---|---|---|
| 2019/0335676 | A1* | 11/2019 | Solomon | A01G 31/042 |
| 2020/0281128 | A1* | 9/2020 | Erickson | A01G 9/18 |
| 2021/0307258 | A1* | 10/2021 | Clark | A01G 9/18 |
| 2022/0400625 | A1* | 12/2022 | Gordon | F24D 11/0264 |
| 2023/0014943 | A1* | 1/2023 | Mihelich | G05D 22/02 |
| 2023/0073284 | A1* | 3/2023 | Hernandez | A01G 9/246 |
| 2023/0157217 | A1* | 5/2023 | Doyle | A01G 7/045 47/58.1 LS |

OTHER PUBLICATIONS

The Ultimate Vapor Pressure Deficit (VPD) Guide, Peter Koverda, Feb. 12, 2020. (Year: 2020).*

* cited by examiner

AIR CONDITIONING DEVICE AND METHOD WITH VAPOR PRESSURE DEFICIT CONTROL

FIELD OF INVENTION

This invention relates to vapor pressure deficiency control device and method for indoor plant cultivation, and in particular to vapor pressure deficiency control device and method for residential indoor cannabis cultivation to increase cannabis yields.

BACKGROUND OF INVENTION

Commercial indoor plant growers use temperature and humidity parameters to fine tune their cultivation environment to increase plant yield, but for emerging residential indoor growers, they often lack the tools needed to maintain an optimal growing environment with temperature and humidity. Such tools include for example, humidifier, dehumidifier, air conditioner, and heater.

An object of the invention is to provide an improved and efficient device and method to control the residential indoor cannabis cultivation environment using vapor pressure deficiency ("VPD" hereafter.) By utilizing VPD, residential growers can eliminate at least one or two of the above-mentioned expensive equipment's while still maintaining the same optimal cultivation environment as long as the temperature and humidity of the cultivation space does not reach extreme levels. This is because both the heater and the dehumidifier are able to increase VPD, while both the air conditioner and humidifier are able to decrease VPD.

SUMMARY OF INVENTION

Vapor Pressure Deficit, or VPD, plays a crucial role in plant indoor cultivation, especially high valued plants, such as cannabis. VPD is the difference between moisture that is currently in the air and how much moisture the air can hold at saturation, or dew point under certain conditions.

According to an embodiment of the invention, an air conditioning device with VPD control for indoor residential cannabis cultivation is disclosed. The air conditioning device with VPD control includes: a control module with a processing unit, a display screen and an IO interface; a cooling unit for providing cold air in response to a cooling unit control signal from the control module; a fan for circulating cold air in response to a fan control signal from the control module; and a temperature-humidity sensor for sensing an environmental temperature value T and an environmental relative humidity value RH within an indoor cannabis cultivation environment, the environmental temperature value $T_{ENV}$ and the environmental relative humidity value $RH_{ENV}$ are transmitted to the control module in real time, and a leaf VPD value $VPD_{LEAF}$ is calculated from the environmental temperature value $T_{ENV}$ and the environmental relative humidity value $RH_{ENV}$ by the processing unit of the control module.

According to an embodiment of the invention, the leaf VPD value $VPD_{LEAF}$ is compared with a pre-determined VPD threshold value $VPD_{\theta}$ to determine running modes of the air conditioning device to control the leaf VPD value $VPD_{LEAF}$ within the indoor cannabis cultivation environment, and the control module transmits the cooling unit control signal to the cooling unit to adjust the environmental temperature value $T_{ENV}$ and the environmental relative humidity value $RH_{ENV}$ within the indoor cannabis cultivation environment. According to an embodiment of the invention, the temperature-humidity sensor senses an updated environmental temperature value $T_{ENV}$ and an updated environmental relative humidity value $RH_{ENV}$ within the indoor cannabis cultivation environment; the updated environmental temperature value $T_{ENV}$ and the updated environmental relative humidity value $RH_{ENV}$ are transmitted to the control module; and an updated leaf VPD value $VPD_{LEAF}$ is calculated from the updated environmental temperature value $T_{ENV}$ and the updated environmental relative humidity value $RH_{ENV}$ by the processing unit of the control module. According to an embodiment of the invention, the updated leaf VPD value $VPD_{LEAF}$ is compared with the pre-determined VPD threshold value $VPD_{\theta}$ again to adjust the running modes of the cooling unit to control the leaf VPD within the indoor cannabis cultivation environment; and the control module transmits the cooling unit control signal to the cooling unit to adjust the environmental temperature value $T_{ENV}$ and the environmental relative humidity value $RH_{ENV}$ within the indoor cannabis cultivation environment.

According to an embodiment of the invention, an air conditioning device with VPD control for indoor residential cannabis cultivation is disclosed. The air conditioning device with VPD control includes: a power unit for providing electric power to the air conditioning device with VPD control for indoor residential cannabis cultivation; a fan driven by a motor, wherein the fan includes a plurality of fan speed gears under a fan mode; a cooling unit for providing cold air to the air conditioning device with VPD control for indoor residential cannabis cultivation, the air conditioning device includes a plurality of cooling power gears under a cooling mode; an IO interface for input and output of control information and status information; a temperature-humidity sensor for sensing an environmental temperature value $T_{ENV}$ and an environmental relative humidity value $RH_{ENV}$ within an indoor cannabis cultivation environment, wherein a leaf VPD value $VPD_{LEAF}$is calculated from the environmental temperature value $T_{ENV}$ and the environmental relative humidity value $RH_{ENV}$; and a main control unit for communicating with and controlling the power unit, the fan, the motor, the cooling unit, the IO interface, and the temperature-humidity sensor, wherein, in a cooling mode of the air conditioning device with VPD control, the leaf VPD value $VPD_{LEAF}$ calculated from the environmental temperature value $T_{ENV}$ and the environmental relative humidity value $RH_{ENV}$ is implemented to control the air conditioning device with VPD control for indoor residential cannabis cultivation.

According to an embodiment of the invention, the leaf VDP value $VPD_{LEAF}$ is calculated from the environmental temperature value $T_{ENV}$, leaf temperature $T_{LEAF}$ and the environmental relative humidity value $RH_{ENV}$ by:

$$\text{Leaf } VPD = 610.78e^{17.2694\frac{T_{LEAF}}{237.3+T_{LEAF}}} - 610.78e^{17.2694\frac{T_{ENV}}{237.3T_{ENV}}} \times \frac{RH_{ENV}}{100},$$

the VPD unit is in Pa, $T_{ENV}$ is the temperature of the environment in degrees Celsius, $T_{LEAF}$ is the temperature of the leaf in degrees Celsius, $RH_{ENV}$ is relative humidity of air in % unit and e≈2.71828.

According to an embodiment of the invention, $T_{LEAF}=T_{ENV}$+Leaf Offset, when the Leaf Offset is defaulted to 0° C., the leaf VPD value $VPD_{LEAF}$ is calculated from the environmental temperature value $T_{ENV}$ and the environmental relative humidity value $RH_{ENV}$ via:

$$\text{Leaf } VPD = 610.78e^{17.2694\frac{T_{ENV}}{237.3+T_{ENV}}}\left(1-\frac{RH_{ENV}}{100}\right),$$

Leaf VPD unit is in Pa, $T_{ENV}$ is temperature of the air in degrees Celsius, $RH_{ENV}$ is relative humidity of air in % unit and e≈2.71828.

According to an embodiment of the invention, the user can set a Leaf Offset value between −10° C. and 10° C. According to an embodiment of the invention, in the cooling mode, when the leaf VPD value $VPD_{LEAF}$ is greater than or equal to a predetermined threshold $VPD_{\theta}$, the cooling power gear is increased gradually to a Max-level cooling power gear set in the ON cooling mode, when the leaf VPD value $VPD_{LEAF}$ is lower than the predetermined threshold $VPD_{\theta}$, the cooling power gear is decreased gradually to a Min-level cooling power gear set in the OFF cooling mode.

According to an embodiment of the invention, in an AUTO cooling mode, a temperature threshold value is set between 0 and 100 using the IO interface, when the environmental temperature value $T_{ENV}$ is greater than or equal to the temperature threshold value, the cooling power gear is increased gradually to the Max-level cooling power gear set in the ON cooling mode, when the environmental temperature value T is smaller than the temperature threshold value, the cooling power gear is decreased gradually to the Min-level cooling power gear set in the OFF cooling mode. According to an embodiment of the invention, in a TIMER cooling mode, a countdown timer is set using the IO interface, wherein when the countdown time is not zero, the Max-level cooling power gear is run, wherein when the countdown time reaches zero, the Min-level cooling power gear is run. According to an embodiment of the invention, in a CYCLE cooling mode, an ON-time is set, and an OFF-time is set using the IO interface, wherein during the ON-time, the Max-level cooling power gear is run, wherein during the OFF-time, the Min-level cooling power gear is run.

According to an embodiment of the invention, an air conditioning device with VPD control is disclosed. The air conditioning device with VPD control includes: a top cover, a front-side enclosure wall, a rear-side enclosure wall, a left-side enclosure wall, and a right-side enclosure wall, wherein openings are implemented on the enclosure walls to facilitate air entry and exit of the enclosure of the air conditioning device with VPD control; a cooling unit with an evaporator and a condenser; a bottom cover of the enclosure; a control panel with a display screen mounted on the top cover; a control module integrated into the control panel with a user IO interface for input and output of control information; a fan enclosed in the side enclosure walls of the air conditioning device with VPD control, the fan is implemented for circulating the air treated by the air conditioning device with VPD control into the indoor residential cannabis cultivation environment in response to a fan control signal from the control module; and a temperature-humidity sensor for sensing an environmental temperature value $T_{ENV}$ and an environmental relative humidity value $RH_{ENV}$ within the indoor cannabis cultivation environment.

According to an embodiment of the invention, the environmental temperature value $T_{ENV}$ and the environmental relative humidity value $RH_{ENV}$ are transmitted to the control module in real time, and a leaf VPD value $VPD_{LEAF}$ is calculated from the environmental temperature value $T_{ENV}$ and the environmental relative humidity value $RH_{ENV}$ by the processing unit of the control module. According to an embodiment of the invention, the air conditioning device with VPD control further includes: an upper air hood mounted on an opening on one of the side enclosure walls for the evaporator; and a lower air hood mounted on an opening on one of the side enclosure walls for the condenser, a hose is connected to the upper air hood to direct air flow for the evaporator, and a second hose is connected to the lower air hood to direct air flow for the condenser. According to an embodiment of the invention, the air conditioning device with VPD control further includes: a hot air outlet and a cold air outlet on the side enclosure walls, when the air conditioning device is started, ambient air enters through the lower air hood and goes out through the hot air outlet, or ambient air enters through the upper air hood and goes out through the cold air outlet. According to an embodiment of the invention, the air conditioning device with VPD control further includes: a USB-C connector mounted on the rear cover of the enclosure for connecting an external controller to the control module in the enclosure for additional controls. According to an embodiment of the invention, the air conditioning device with VPD control further includes: an audio headphone jack mounted on the rear cover of the enclosure for connecting to the temperature-humidity sensor outside the enclosure. According to an embodiment of the invention, the air conditioning device with VPD control further includes an evaporator screen frame and a condenser screen frame. According to an embodiment of the invention, the air conditioning device with VPD control further includes air louvers on at least one of the openings implemented on the side enclosure walls.

BRIEF DESCRIPTION OF THE FIGURES

The invention will now be explained in more detail using exemplary embodiments and with references to the drawings, in which.

DETAILED DESCRIPTION OF PREFERRED EMBODIMENTS

Figure 1:
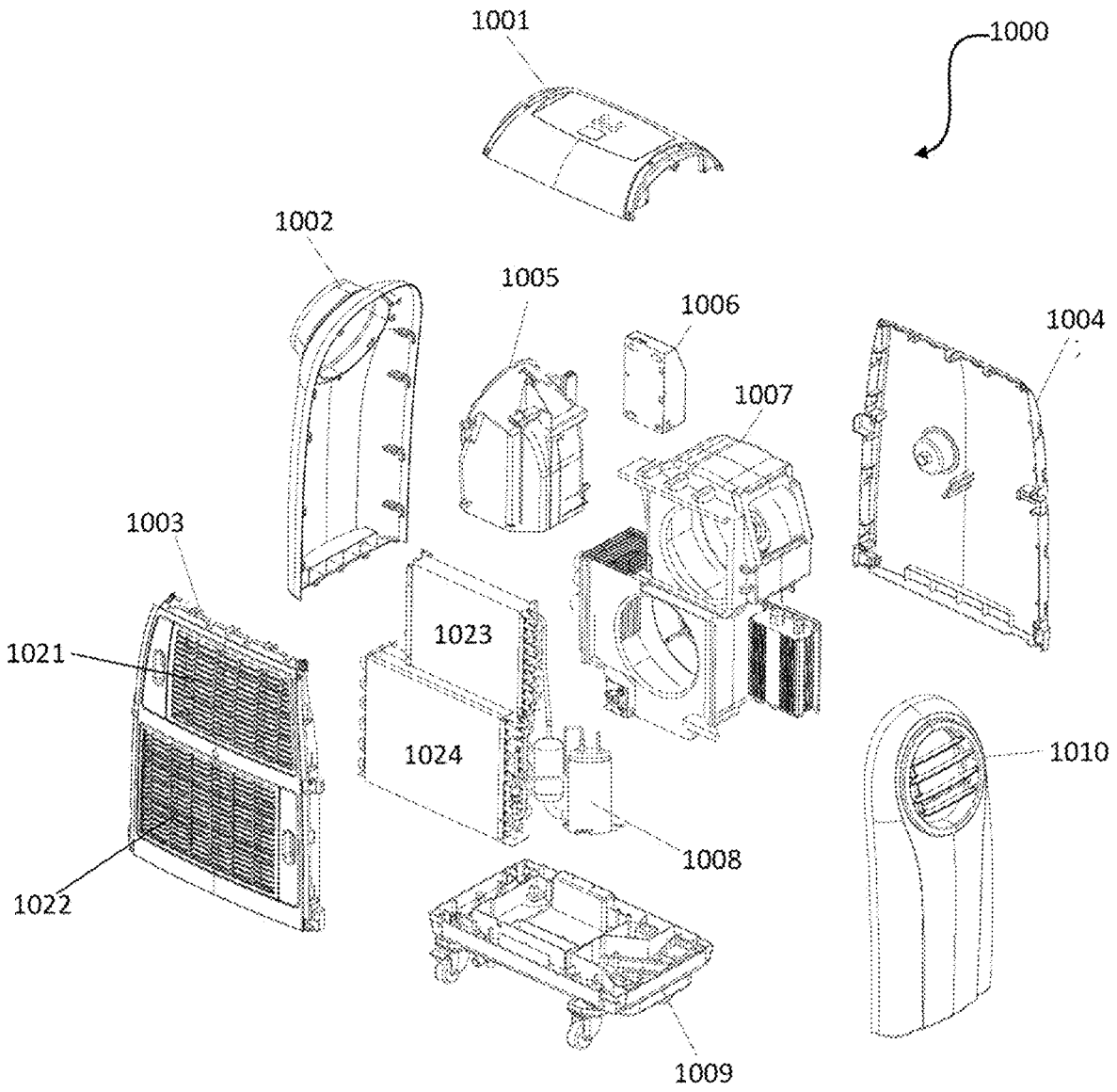
FIG. 1 is an exploded view of the air conditioning device with VPD control, according to an embodiment of the invention.

The invention is susceptible of many embodiments. Preferred embodiments are illustrated in the attached figures and explained below. Minor variations of the preferred embodiments are evident in the figures, but are substantially the same, with common or similar components and the same reference numbers, except as noted.

The saturation vapor pressure deficit of an air sample (sometimes "vapor pressure deficit, VPD" or just "saturation deficit" for short) is the difference between the saturation vapor pressure and the actual vapor pressure at temperature T, i.e., SVP (Saturation Vapor Pressure)–AVP (Actual Vapor Pressure). VPD is the difference between moisture that is currently in the air and how much moisture the air can hold at saturation, or dew point under certain conditions. In ecological problems, VPD is often regarded as a measure of the "drying power" of air, because it plays an important part in determining the relative rates of growth and transpiration in plants. In micrometeorology, the vertical gradient of saturation deficit is a measure of the lack of equilibrium between a wet surface and the air passing over it. Vapor Pressure Deficit ("VPD") plays a crucial role in plant indoor cultivation, especially high valued plants, such as cannabis.

The environment VPD can be calculated from environmental temperature value $T_{ENV}$ and the environmental relative humidity value $RH_{ENV}$. By definition, VPD=SVP (Saturation Vapor Pressure)–AVP (Actual Vapor Pressure), SVP is the "Saturation Vapor Pressure" and AVP is the "Actual Vapor Pressure".

a.

$$SVP = 610.78e^{17.2694\frac{T_{ENV}}{237.3+T_{ENV}}},$$

wherein, 610.78, 17.2694 and 237.3 are constants, and $T_{ENV}$ is temperature of the environment in degrees Celsius.

b.

$$AVP = 610.78e^{17.2694\frac{T_{ENV}}{237.3+T_{ENV}}}\frac{RH_{ENV}}{100},$$

wherein, $RH_{ENV}$ is the relative humidity of environment in % unit, and 610.78, 17.2694 and 237.3 are constants, $T_{ENV}$ is temperature of the environment in degrees Celsius.

c.

$$\text{Environment } VPD = SVP - AVP = 610.78e^{17.2694\frac{T_{ENV}}{237.3+T_{ENV}}}\left(1 - \frac{RH_{ENV}}{100}\right),$$

wherein, $VPD_{ENV}$ unit is in Pa, $T_{ENV}$ is temperature of the environment in degrees Celsius. $RH_{ENV}$ is the relative humidity of environment in % unit, e≈2.71828.

The SVP value can be calculated by, for example, the following code:

```
/**********************VPD**************************/
double get_svp (double t)
{
  double svp, power;
  power = t / (t + 237.3) * 17.2694;
  svp = 610.78 * pow (2.71828, power);
  return svp;
}
```

The code shows the calculation of the saturated vapor pressure SVP (Saturation Vapor Pressure) from a temperature of the environment T. The unit is Pa. On the display, it is possible to display either Pa or kPa, or other units if appropriate.

According to another embodiment of the invention, the VPD can be calculated by following the steps below:

a. Obtaining real time environment temperature value $T_{ENV}$ (° C.) and real time environmental relative humidity value $RH_{ENV}$;

b. Calculating the leaf temperature value $T_{LEAF}=T_{ENV}+$ Leaf Offset, wherein $T_{ENV}$ (° C.) is real time environment temperature, $T_{LEAF}$ (° C.) is leaf temperature, Leaf Offset is the difference between the leaf and the air temperature, Leaf Offset=$T_{LEAF}-T_{ENV}$;

c. Calculating ASVP, which is the environment SVP, wherein $$ASVP = 610.78e^{17.2694\frac{T_{ENV}}{237.3+T_{ENV}}};$$

d. Calculating LSVP, which is the leaf SVP, wherein $$LSVP = 610.78e^{17.2694\frac{T_{LEAF}}{237.3+T_{LEAF}}};$$

e. Calculating leaf VPD, wherein Leaf VPD value $VPD_{LEAF}$=LSVP–(ASVP×RH/100);

f. Calculating real time Leaf VPD, wherein Leaf VPD value $$VPD_{LEAF} = LSVP - ASVP \times RH/100 = 610.78e^{17.2694\frac{T_{LEAF}}{237.3+T_{LEAF}}} - 610.78e^{17.2694\frac{T_{ENV}}{237.3+T_{ENV}}} \times \frac{RH_{ENV}}{100},$$

wherein the unit of Leaf VPD value $VPD_{LEAF}$ is Pa, the unit of temperature is ° C., the unit of RH is %, and e≈2.71828.

The default value of Leaf Offset is 0, which means that T+Leaf Offset=T in the above equations, and the default value of the leaf VPD is equal to air VPD, i.e., under the default condition, $$\text{Leaf } VPD = 610.78e^{17.2694\frac{T_{ENV}}{237.3+T_{ENV}}}\left(1-\frac{RH_{ENV}}{100}\right).$$

VPD plays an important role in cannabis cultivation. Plants respond to changes in water availability in both their aerial and soil environments. The driving force of transpiration rate is the gradient in vapour pressure between the dry atmosphere and the wet interior of leaves, which is referred to as VPD as discussed above.

A high VPD indicates a hotter and drier environment, while a low VPD results from a cooler and more humid environment. Scientific studies have demonstrated that the cannabis is highly responsive to changes in VPD, and VPD has been identified as a critical factor influencing transpiration and stomatal conductance in crops including cannabis.

Figure 10:
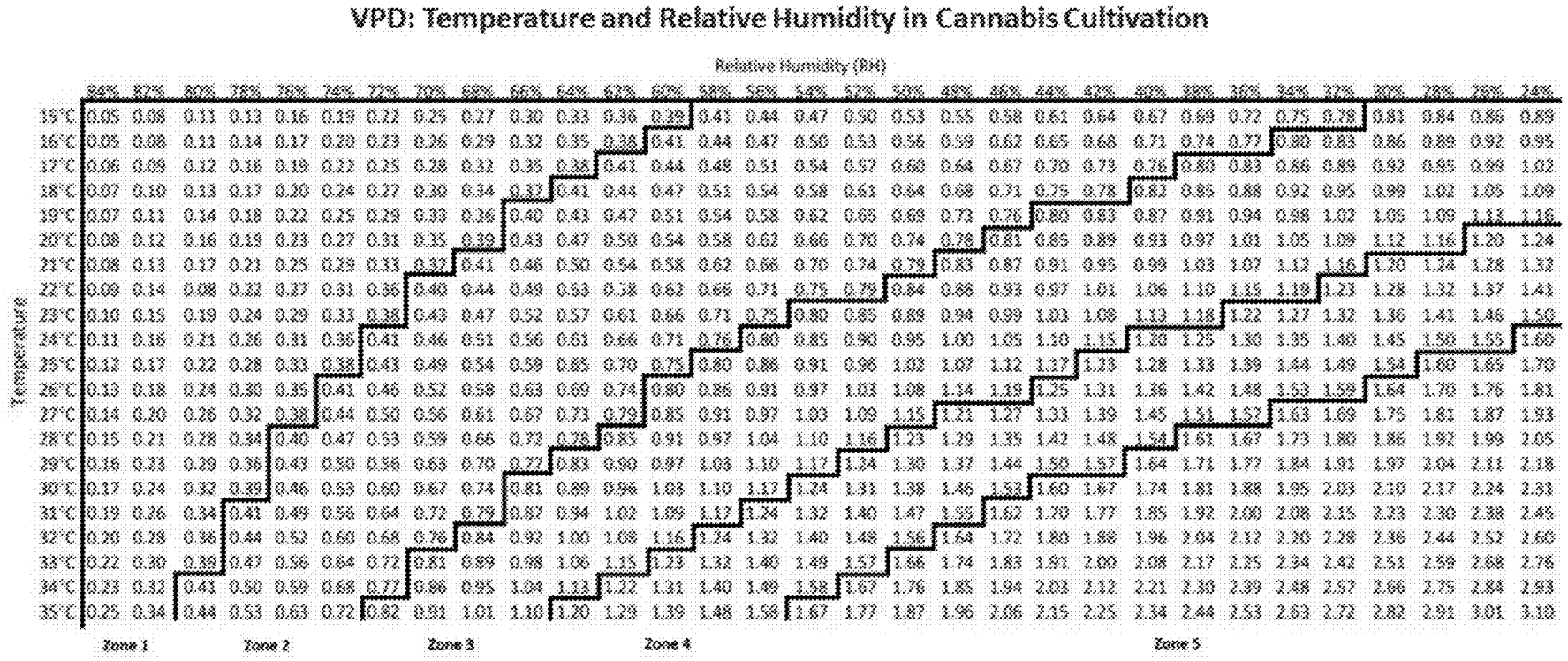
FIG. 10 is a chart illustrating the relationship among VPD, temperature and relative humidity in cannabis cultivation, according to an embodiment of the invention.

For cannabis growers with indoor grow tents or rooms with artificial lighting, in addition to temperature and relative humidity parameters, it is critical to take into consideration the importance of VPD and its impact on transpiration or nutrient uptake. For example, as illustrated in FIG. 10, in the chart depicting the relationship between temperature, humidity and VPD below, there are five zones: zone 1 through zone 5, with different combinations of temperature and relative humidity values. For example, zone 1: danger zone; zone 2: blue zone for low transpiration stage, propagation stage and early vegetative stage; zone 3: green zone for optimized healthy growth during transpiration stage, late vegetative state, and early flower stage; zone 4: yellow zone for high transpiration stage and late flower stage; zone 5: danger zone. Among these zones, zone 3 is the optimal zone with ideal combinations of temperature and relative humidity value for cannabis plants. For different stages, such as growth and flowering stages, temperature, relative humidity, and the recommended leaf VPD values are listed in the chart in FIG. 10.

Different VPD values are recommended for different stages of the plant. For example, for VPD value between 1.20 kPa and 1.60 kPa, which is considered relatively high, plants tend to open their stomata and release a considerable amount of water vapour into the environment to increase their transpiration. This increase in transpiration results in an increase in the plant's photosynthetic activity and will improve its overall growth during both growth and bloom. The optimal VPD range is between 0.80 kPa and 1.20 kPa. When the VPD is too high, the plant closes its stomata to avoid releasing excessive amount of the water vapor into the environment. Excessive transpiration causes dehydration. On the other hand, when VPD is too low, the atmosphere is already saturated and has reached the maximum water retention capacity, the plant will also close its stomata to avoid releasing too much water vapor into the atmosphere. Decreased transpiration reduces photosynthesis, slowing the plant's development and lowering yield.

There are two types of VPD's: air VPD and leaf VPD. Leaf VPD is what is been calculated in the present invention, which assumes that a leaf surface temperature is the same as the air temperature. This may not, however, always be the case due to external factors, such as light shining on a leaf causing it to heat up. According to the embodiment of the invention, there is an option in the air conditioner settings to allow users to measure and input the leaf surface temperature in relation to the air temperature (leaf offset), which will change the Air VPD reading to an estimated leaf VPD reading.

FIG. 1 is an exploded view of the air conditioning device with VPD control, according to an embodiment of the invention. The air conditioning device with VPD control 1000 is enclosed within an enclosure formed by an upper cover 1001, a bottom module 1009, a front cover 1010, a rear cover 1002, a left cover 1003, and a right cover 1004. The enclosure includes other components of the air conditioning device, such as the compressor 1008, as well as the control board module 1006, the exhaust casing 1005 and the air duct component 1007. The compressor 1008, together with the evaporator 1023 and the condenser 1024, cools down the air fed into it and provider colder air to the cultivation environment through appropriate air ducts. Evaporators are heat exchangers that transfer heat from the process fluid into the refrigerant causing a phase change, evaporation. In an evaporator, the refrigerant enters as a low-pressure liquid/vapor mixture and exits as a low-pressure gas. The change of state from liquid to gas occurs at a constant temperature and absorbs energy. A chiller's evaporator achieves superheated refrigerant vapor. Superheat is when all the liquid refrigerant has evaporated, and the gas temperature increases above its saturation temperature. The process fluid enters as a hot liquid and exits at a lower temperature after transferring energy to the refrigerant. The condenser and the evaporator coils work together to create cool air. A condenser is designed to transfer heat from a working fluid to a secondary fluid or the surrounding air. The condenser relies on the efficient heat transfer that occurs during phase changes, in this case during the condensation of a vapor into a liquid. The vapor typically enters the condenser at a temperature above that of the secondary fluid. As the vapor cools, it reaches the saturation temperature, condenses into liquid, and releases large quantities of latent heat.

According to an embodiment of the invention, the air conditioning device with VPD control has a compressor 1008 as the cooling unit and a heating unit—both the compressor and the heating unit need to be running for the air conditioning device with VPD control to work. When the air conditioning device with VPD control is turned on, air is brought through both the cooling unit and the heating unit and then the user can decide where the hot and cold air goes. According to an embodiment of the invention, typically the hot air is exhausted outside, and the cold air is directed to the area that needs to be cooled. According to an embodiment of the invention, the cooling unit can be implemented to work as a heater for the above-mentioned reason, when the cold air is exhausted outside, and the hot air is directed to the area that needs to be heated. According to an embodiment of the invention, the cooling unit can also be implemented to work as a dehumidifier for the above-mentioned reason, when both the cold and hot air are directed inside, and the byproduct of the cooling unit, i.e., the collecting water, is used to lower the humidity of the air.

Figure 2:
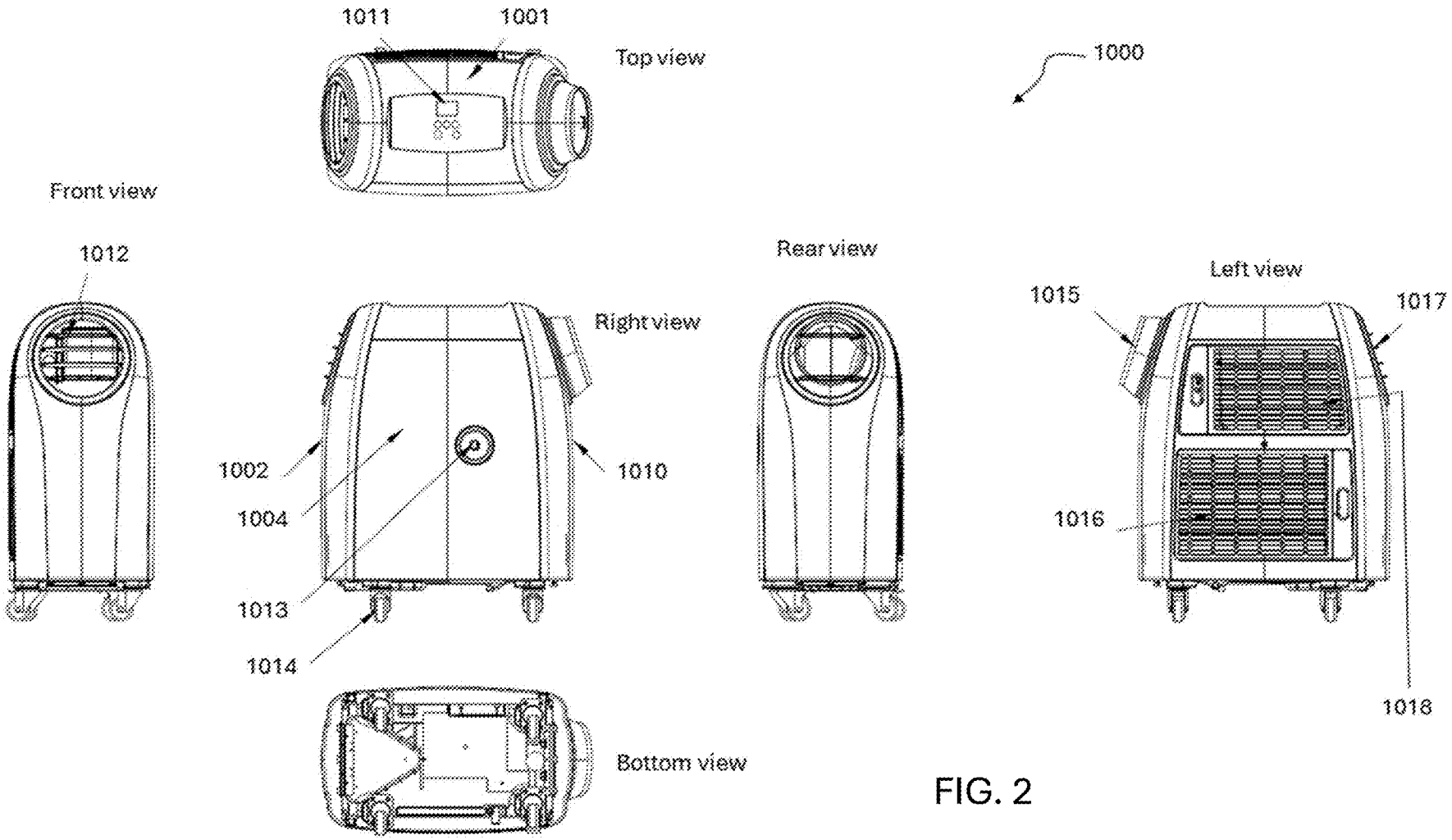
FIG. 2 is a view of the air conditioning device with VPD control in all directions, according to an embodiment of the invention.
Figure 6:
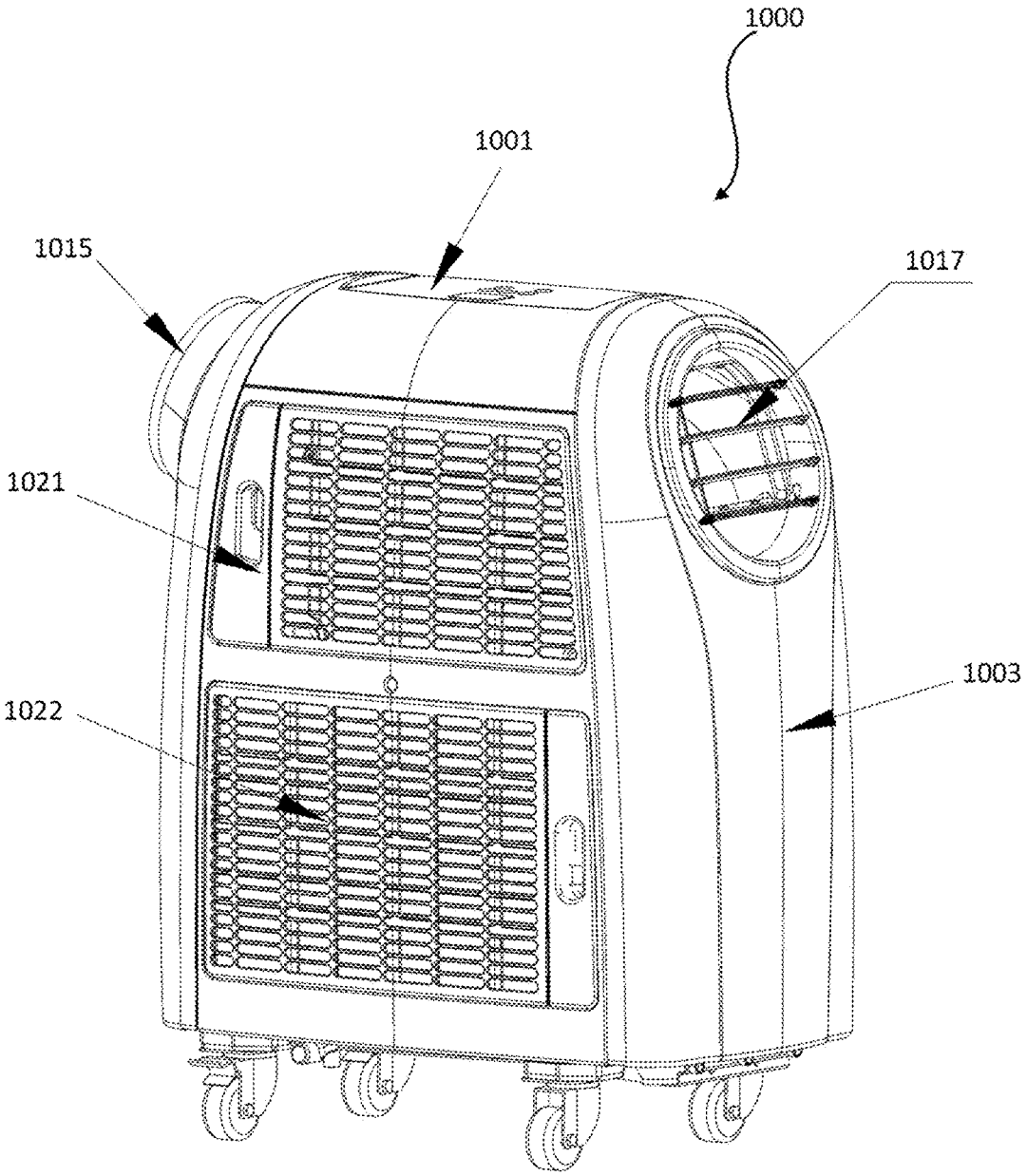
FIG. 6 is a view of the air conditioning device with VPD control without air hoods mounted, according to an embodiment of the invention.

FIG. 2 is a view of the air conditioning device with VPD control in all directions, according to an embodiment of the invention. From the top view of the air conditioning device with VPD control 1000, a display screen 1011 is implemented on the upper cover 1001 for displaying control information. The display screen 1011, according to some embodiments, can be a regular LCD screen, or a touch screen, additional buttons and keys can be implemented with the screen for additional controls. In the front view, a cold air louver is implemented on the front cover 1010 as an exit of air flow. In the right view, a water-exit 1013 is implemented to let water flow exit out of the enclosure of the air conditioning device with VPD control 1000. In the left view, a hot air exit 1015, a cold air exit 1017, a cold air entry 1016 and a hot air entry 1018 are implemented correspondingly. A corresponding perspective view is illustrated in FIG. 6 below.

Figure 3:
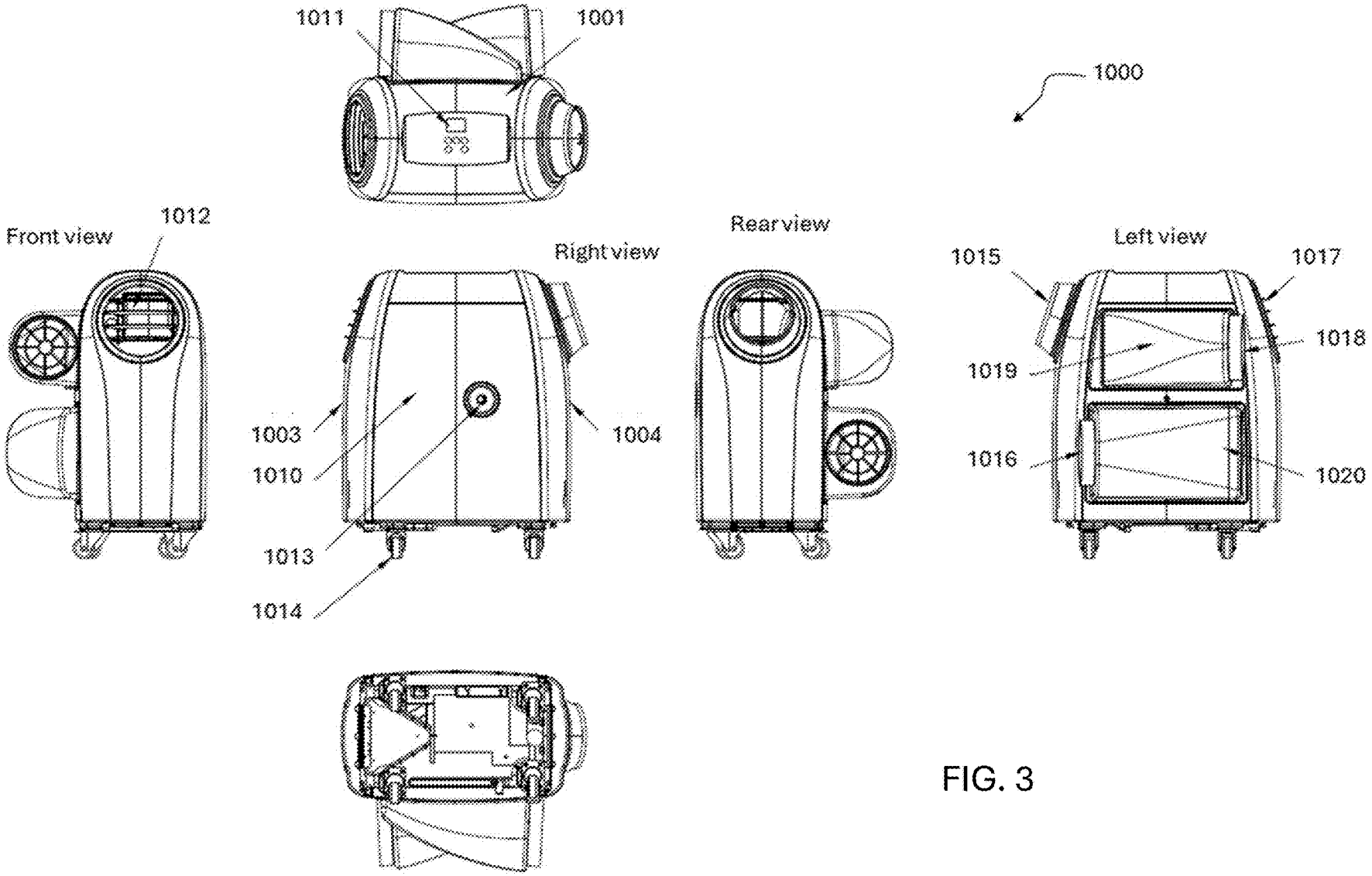
FIG. 3 is a view of the air conditioning device with VPD control with air hoods mounted, according to an embodiment of the invention.
Figure 5:
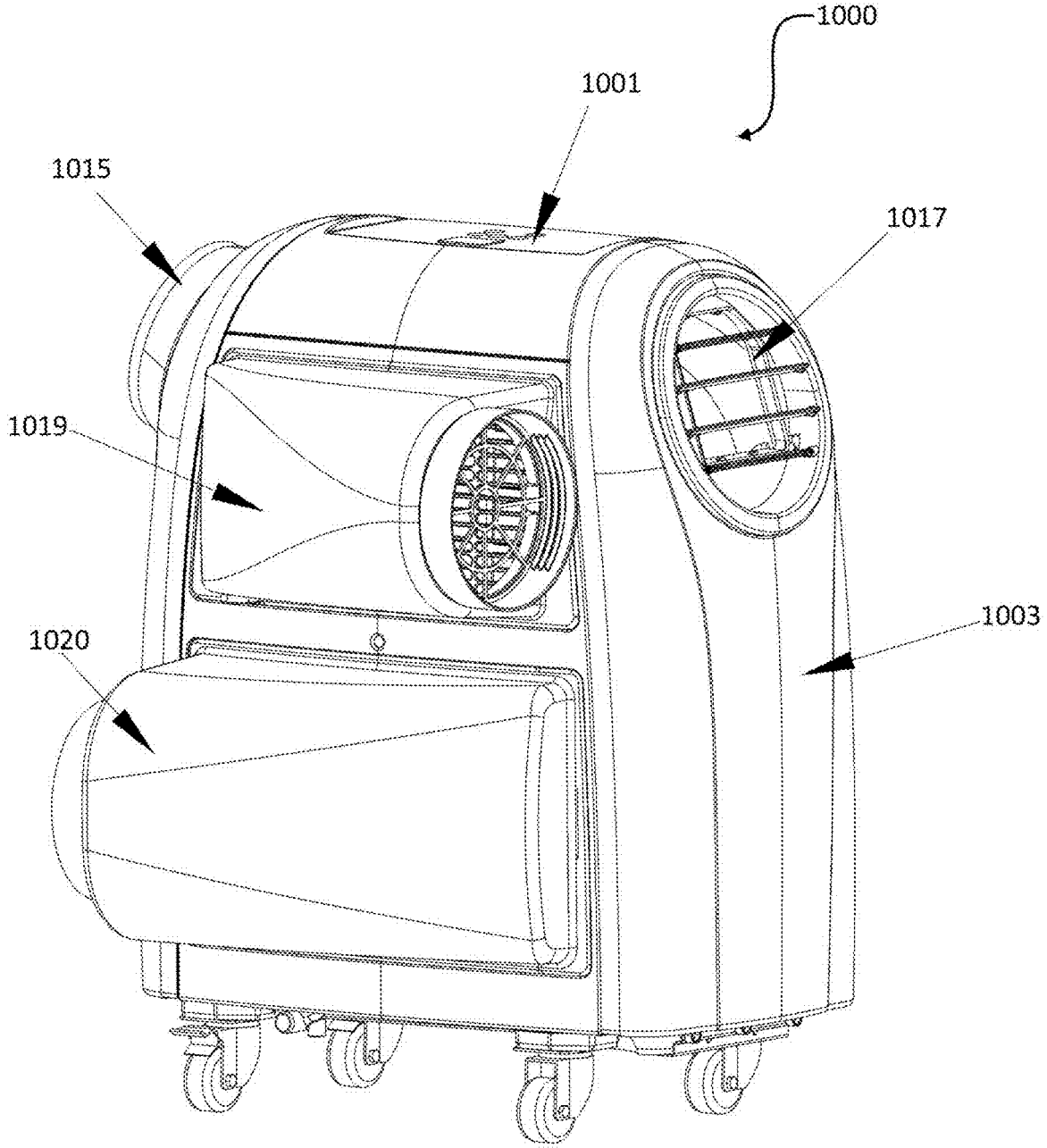
FIG. 5 is a view of the air conditioning device with VPD control with air hoods mounted, according to an embodiment of the invention.

FIG. 3 is a view of the air conditioning device with VPD control with air hoods mounted, according to an embodiment of the invention. In this view, an upper return air hood 1019 and a lower return air hood 1020 are implemented to direct airflow into the enclosure of the air conditioning device with VPD control 1000. In the left view, a cold air entry 1016, a lower return air hood 1020, a hot air entry 1018 and an upper return air hood 1019 are implemented to enable hot and cold air entry of the enclosure of the air conditioning device with VPD control 1000. A corresponding perspective view is illustrated in FIG. 5 below.

According to an embodiment of the invention, the power of the air conditioning device includes 10 levels or called gears. According to an embodiment of the invention, the air conditioning device with VPD control can be implemented with a fixed frequency air conditioner or can be implemented with an inverter air conditioner.

The fixed frequency air conditioning device gears are detailed in the table below:

| Fixed Frequency Air Conditioner | | |
|---|---|---|
| AC/Cooling Gear | Corresponding AC/ Cooling Duty Cycle (%) | AC Power |
| Gear-0 | 0 | Fixed |
| Gear-1 | 56 | Fixed |
| Gear-2 | 60 | Fixed |
| Gear-3 | 64 | Fixed |
| Gear-4 | 68 | Fixed |
| Gear-5 | 73 | Fixed |
| Gear-6 | 78 | Fixed |
| Gear-7 | 83 | Fixed |
| Gear-8 | 88 | Fixed |
| Gear-9 | 93 | Fixed |
| Gear-10 | 100.0 | Fixed |

The inverter air conditioning device gears are detailed in the table below:

| Inverter Air Conditioner | | | |
|---|---|---|---|
| AC/Cooling Gear | Corresponding Fan Duty Cycle (%) | Fan Gear | AC Power |
| Gear-0 | 0 | 0 | Fixed |
| Gear-1 | 56 | 1 | Fixed |
| Gear-2 | 60 | 2 | Fixed |
| Gear-3 | 64 | 3 | Fixed |
| Gear-4 | 68 | 4 | Fixed |
| Gear-5 | 73 | 5 | Fixed |
| Gear-6 | 78 | 6 | Fixed |
| Gear-7 | 83 | 7 | Fixed |
| Gear-8 | 88 | 8 | Fixed |
| Gear-9 | 93 | 9 | Fixed |
| Gear-10 | 100.0 | 10 | Fixed |

Figure 4:
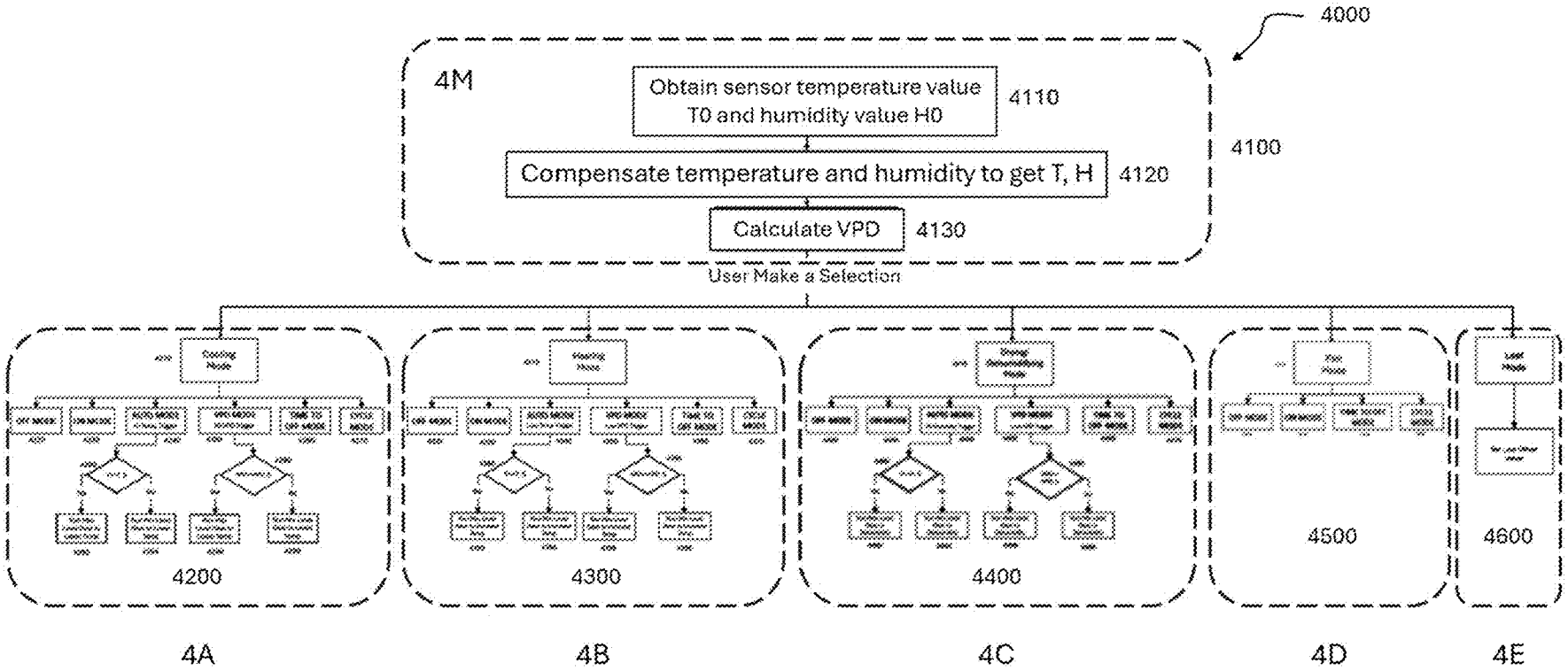
FIG. 4 is a functional flowchart of the air conditioning device with VPD control, according to an embodiment of the invention.

FIG. 4 is a functional flowchart of the air conditioning device with VPD control, according to an embodiment of the invention. The entire control 4000 of the air conditioning device with VPD control includes at least five control modes after the initial steps of 4110, 4120 and 4130 within the 4M control module 4100. The first step 4110 is to obtain sensor temperature value $T_0$ and humidity value $H_0$ in the plant cultivation environment. Then in the next step 4120, to compensate temperature and humidity to get T, H, after which, the next step 4130 calculates VPD value according to appropriate formulas discussed above. When the VPD value is properly calculated, the user makes a selection among the at least five control modes: cooling mode 4A, heating mode 4B, drying mode 4C, fan mode 4D and leaf mode 4E, which are illustrated with further details in FIGS. 4A, 4B, 4C, 4D and 4E, respectively.

Figure 4A:
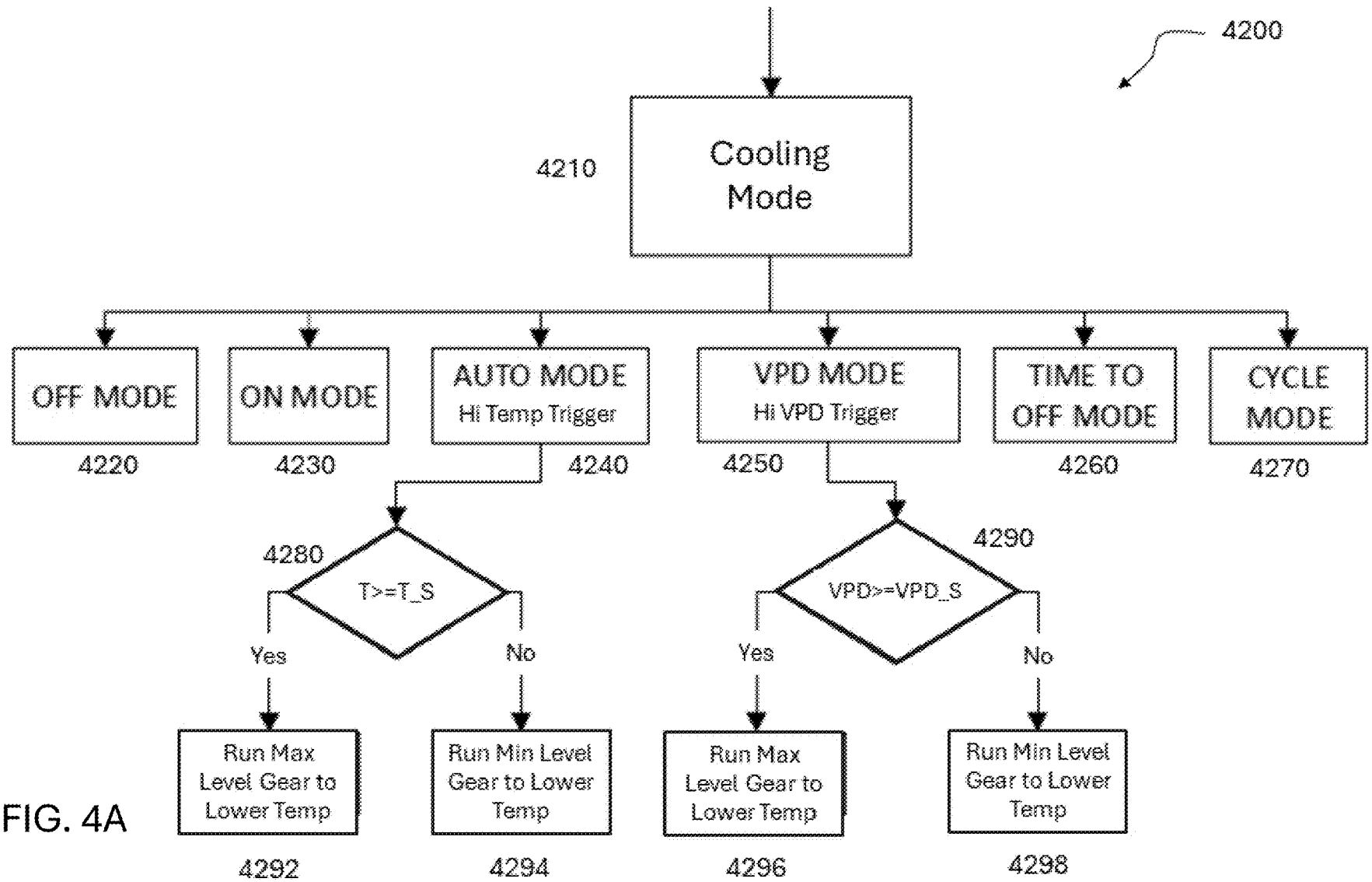
FIG. 4A is a functional flowchart of the cooling mode of the air conditioning device with VPD control, according to an embodiment of the invention.

FIG. 4A is a functional flowchart of the cooling mode of the air conditioning device with VPD control, according to an embodiment of the invention. The cooling mode 4200 of the air conditioning device with VPD control is also called the air conditioning mode, or AC mode. When entering the cooling mode 4210, there are at least 6 sub-control modes: OFF mode 4220, ON mode 4230, AUTO mode 4240, VPD mode 4250, TIMER-TO-OFF mode 4260 and CYCLE mode 4270. According to an embodiment of the invention, when entering the OFF mode 4220, the cooling equipment is not running, and under the OFF mode 4220, the minimum cooling gear Min Level can be set. The OFF mode 4220 is the running mode when other cooling modes are triggered to be OFF. The OFF mode 4220 is defaulted to gear 0.

According to an embodiment of the invention, when entering the ON mode 4230, the cooling equipment keeps running, and under the ON mode 4230, the maximum cooling gear Max Level can be set. The ON mode 4230 is the running mode when other modes are triggered to be ON. The ON mode ranges from cooling gear 0 to gear 10. The ON mode 4230 is defaulted to cooling gear 6.

According to an embodiment of the invention, AUTO mode 4240 is a high temperature trigger mode, when entering the AUTO mode 4240, the current temperature T is compared with a predetermined threshold temperature Ts at step 4280. When T is greater than or equal to Ts, ON mode is triggered in step 4292 to run Max Level cooling gear to lower the temperature; otherwise, when T is smaller than the Ts, then the OFF mode is triggered in step 4294 and the cooling gear is gradually lowered to the Min Level gear set up in the OFF mode. The threshold temperature ranges from 0° C. to 90° C.

According to an embodiment of the invention, VPD mode 4250 is a high VPD trigger mode. The VPD value can be adjusted using the increase/decrease buttons between 0.0 Kpa and 3.0 Kpa with 0.1 Kpa incremental. If the VPD value calculated from the sensor temperature and humidity is greater than or equal to the predetermined threshold VPD value VPDs, then the ON mode is triggered in step 4296, and the cooling gear is gradually increased to the Max Level cooling gear set up in the ON mode. Otherwise, when the VPD value is smaller than the predetermined threshold VPD value VPDs, the OFF mode is triggered in step 4298, and the cooling gear is gradually decreased to the Min Level cooling gear set up in the OFF mode.

According to an embodiment of the invention, in the TIMER-TO-OFF mode 4260, the default timer is set to be 0:00. When the TIMER is not zero, during the TIMER countdown, Max Level cooling gear is run, and when the TIMER counts down to zero, Min Level cooling gear is run. When the TIMER is set to zero, then Min Level cooling gear is run.

According to an embodiment of the invention, in the CYCLE mode 4270, the default setting is zero. In the CYCLE mode 4270, ON time and OFF time can be set respectively. During the ON time, ON mode is run with Max Level cooling gear, while during OFF time, OFF mode is run with Min Level cooling gear. When both ON time and OFF time are set to zero, then cooling gear 0 is run.

Figure 4B:
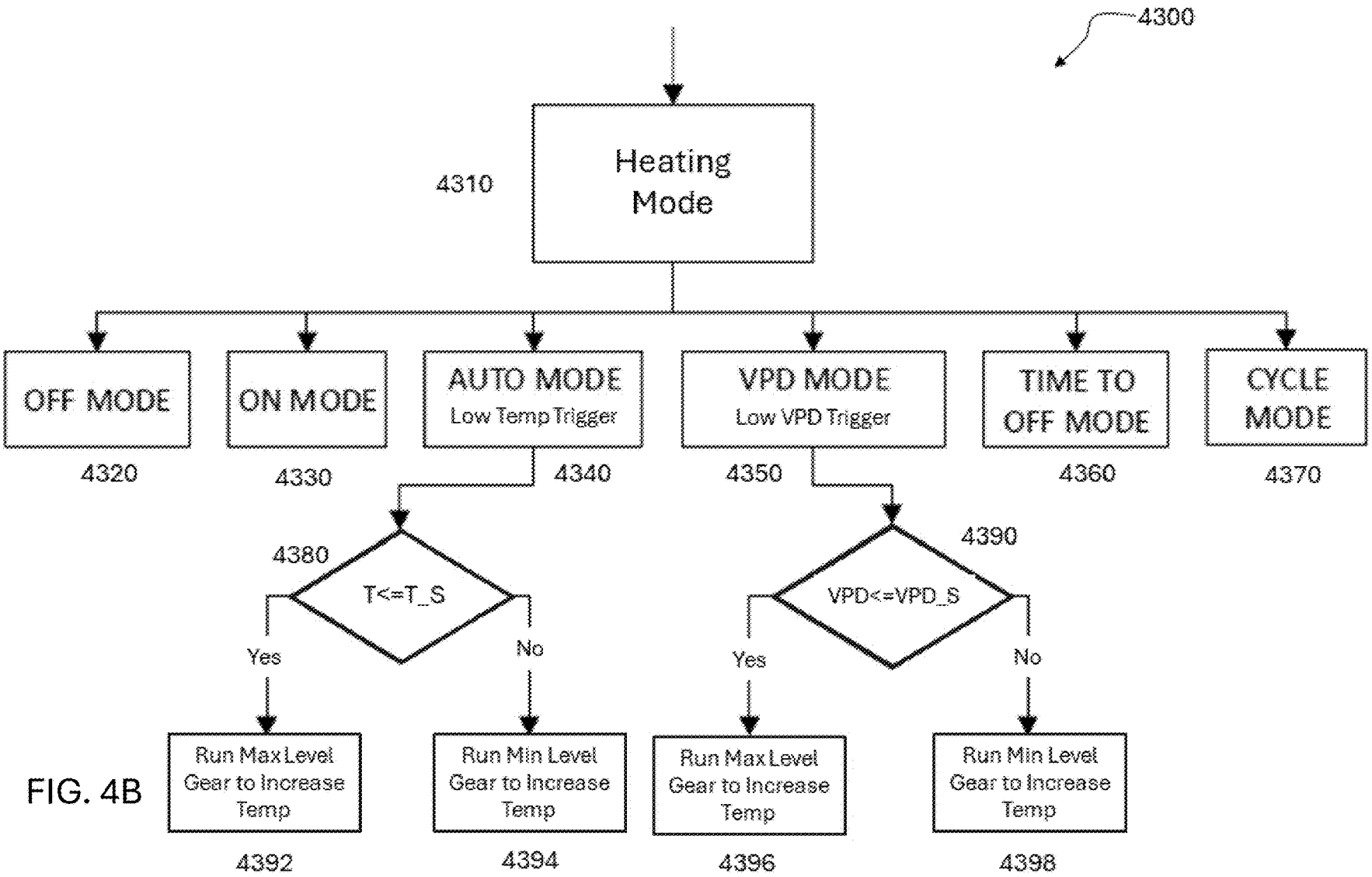
FIG. 4B is a functional flowchart of the heating mode of the air conditioning device with VPD control, according to an embodiment of the invention.

FIG. 4B is a functional flowchart of the heating mode of the air conditioning device with VPD control, according to an embodiment of the invention. The heating mode 4300 of the air conditioning device with VPD control is a mode to increase temperature. When entering the heating mode 4310, there are at least 6 sub-control modes: OFF mode 4320, ON mode 4330, AUTO mode 4340, VPD mode 4350, TIMER-TO-OFF mode 4360 and CYCLE mode 4370. According to an embodiment of the invention, when entering the OFF mode 4320, the heating equipment is not running, and under this OFF mode 4320, the minimum heating gear Min Level can be set. The OFF mode 4320 is the running mode when other modes are triggered to be OFF. The OFF mode 4320 is defaulted to heating gear 0.

According to an embodiment of the invention, when entering the ON mode 4330, the heating equipment keeps running, and under the ON mode 4330, the maximum heating gear Max Level can be set. The ON mode 4330 is the running mode when other modes are triggered to be ON. The ON mode ranges from heating gear 0 to gear 10. The ON mode 4330 is defaulted to heating gear 6.

According to an embodiment of the invention, AUTO mode 4340 is a low temperature trigger mode, when entering the AUTO mode 4340, the current temperature T is compared with a predetermined threshold temperature Ts at step 4380. When Tis smaller than or equal to Ts, ON mode is triggered in step 4392 to run Max Level heating gear to increase the temperature; otherwise, when T is greater than the Ts, then the OFF mode is triggered in step 4394 and the heating gear is gradually lowered to the Min Level heating gear set up in the OFF mode. The threshold temperature ranges from 0° C. to 90° C.

According to an embodiment of the invention, VPD mode 4350 is a low VPD trigger mode, whose default setting is OFF mode. The VPD value can be adjusted using the increase/decrease buttons between 0.0 Kpa and 3.0 Kpa with 0.1 Kpa incremental. If the VPD value calculated from the sensor temperature and humidity is smaller than or equal to the predetermined threshold VPD value VPDs, then the ON mode is triggered in step 4396, and the heating gear is gradually increased to the Max Level heating gear set up in the ON mode. Otherwise, when the VPD value is greater than the predetermined threshold VPD value VPDs, the OFF mode is triggered in step 4398, and the heating gear is gradually decreased to the Min Level heating gear set up in the OFF mode.

According to an embodiment of the invention, in the TIMER-TO-OFF mode 4360, the default timer is set to be 0:00. When the TIMER is not zero, during the TIMER countdown, Max Level heating gear is run, and when the TIMER counts down to zero, Min Level heating gear is run. When the TIMER is set to zero, then Min Level heating gear is run.

According to an embodiment of the invention, in the CYCLE mode 4370, the default setting is zero. In the CYCLE mode 4370, ON time and OFF time can be set respectively. During the ON time, ON mode is run with Max Level heating gear, while during OFF time, OFF mode is run with Min Level heating gear. When both ON time and OFF time are set to zero, then the heating gear 0 is run.

Figure 4C:
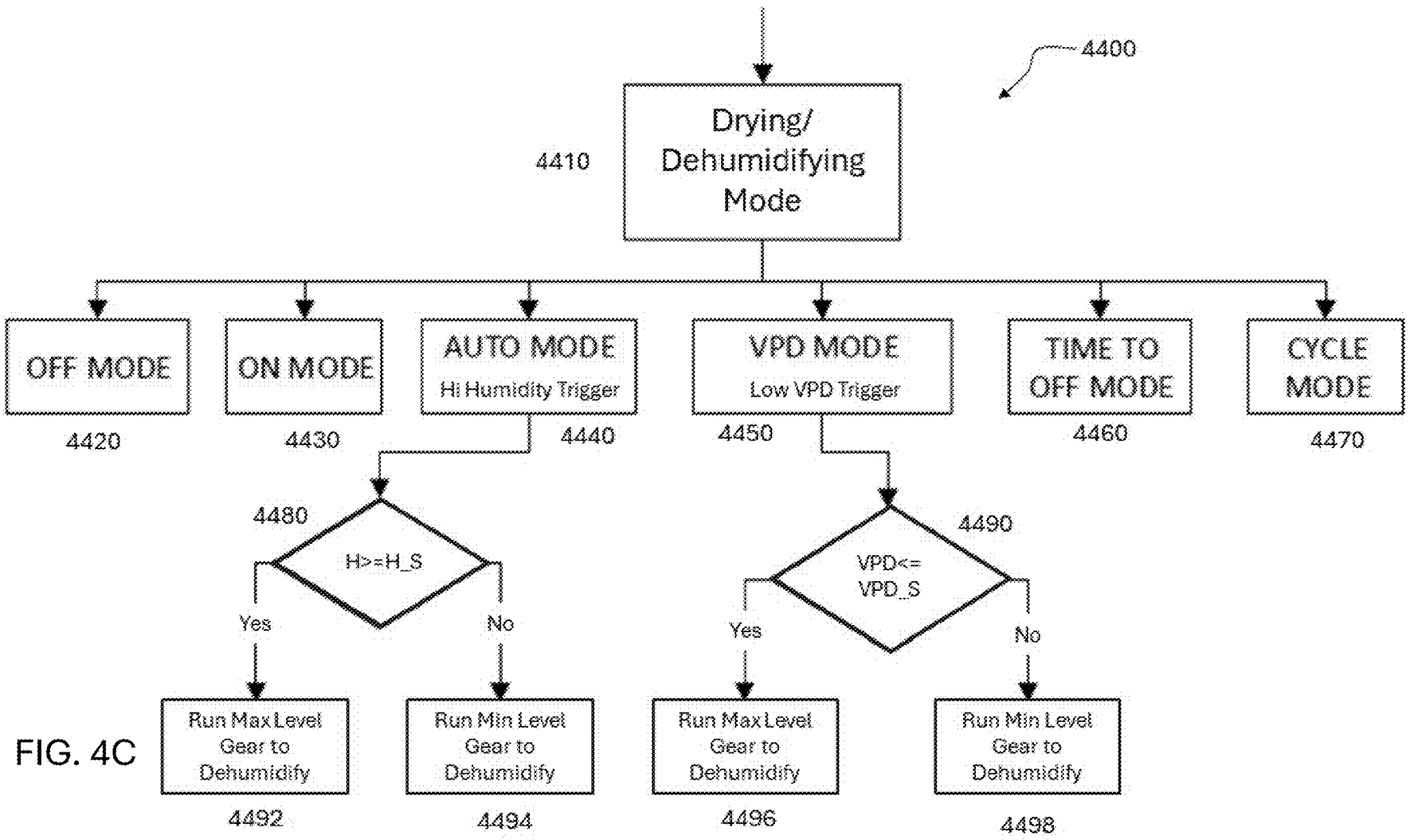
FIG. 4C is a functional flowchart of the drying mode of the air conditioning device with VPD control, according to an embodiment of the invention.

FIG. 4C is a functional flowchart of the drying mode of the air conditioning device with VPD control, according to an embodiment of the invention. The drying mode 4400 of the air conditioning device with VPD control is also called the dehumidifying mode. When entering the drying mode 4410, there are at least 6 sub-control modes: OFF mode 4420, ON mode 4430, AUTO mode 4440, VPD mode 4450, TIMER-TO-OFF mode 4460 and CYCLE mode 4470. According to an embodiment of the invention, when entering the OFF mode 4420, the dehumidifying equipment is not running, and under this OFF mode 4420, the minimum drying gear Min Level can be set. The OFF mode 4420 is the running mode when other modes are triggered to be OFF. The OFF mode 4420 is defaulted to drying gear 0.

According to an embodiment of the invention, when entering the ON mode 4430, the equipment keeps running, and under the ON mode 4230, the maximum drying gear Max Level can be set. The ON mode 4430 is the running mode when other modes are triggered to be ON. The ON mode ranges from drying gear 0 to gear 10. The ON mode 4230 is defaulted to drying gear 6.

According to an embodiment of the invention, AUTO mode 4440 is a high humidity trigger mode, when entering the AUTO mode 4440, the current humidity His compared with a predetermined threshold humidity Hs at step 4480. When His greater than or equal to Hs, ON mode is triggered in step 4492 to run Max Level drying gear to lower the humidity; otherwise, when His smaller than the Hs, then the OFF mode is triggered in step 4494 and the drying gear is gradually lowered to the Min Level drying gear set up in the OFF mode.

According to an embodiment of the invention, the VPD mode 4450 is a low VPD trigger mode, whose default setting is OFF mode. The VPD value can be adjusted using the increase/decrease buttons between 0.0 Kpa and 3.0 Kpa with 0.1 Kpa incremental. If the VPD value calculated from the sensor temperature and humidity is smaller than or equal to the predetermined threshold VPD value VPDs, then the ON mode is triggered in step 4496, and the drying gear is gradually increased to the Max Level drying gear set up in the ON mode. Otherwise, when the VPD value is greater than the predetermined threshold VPD value VPDs, the OFF mode is triggered in step 4498, and the drying gear is gradually decreased to the Min Level drying gear set up in the OFF mode.

According to an embodiment of the invention, in the TIMER-TO-OFF mode 4460, the default timer is set to be 0:00. When the TIMER is not zero, during the TIMER countdown, Max Level drying gear is run, and when the TIMER counts down to zero, Min Level drying gear is run. When the TIMER is set to zero, then Min Level drying gear is run.

According to an embodiment of the invention, in the CYCLE mode 4470, the default setting is zero. In the CYCLE mode 4470, ON time and OFF time can be set respectively. During the ON time, ON mode is run with Max Level drying gear, while during OFF time, OFF mode is run with Min Level drying gear. When both ON time and OFF time are set to zero, then the drying gear 0 is run.

Figure 4D:
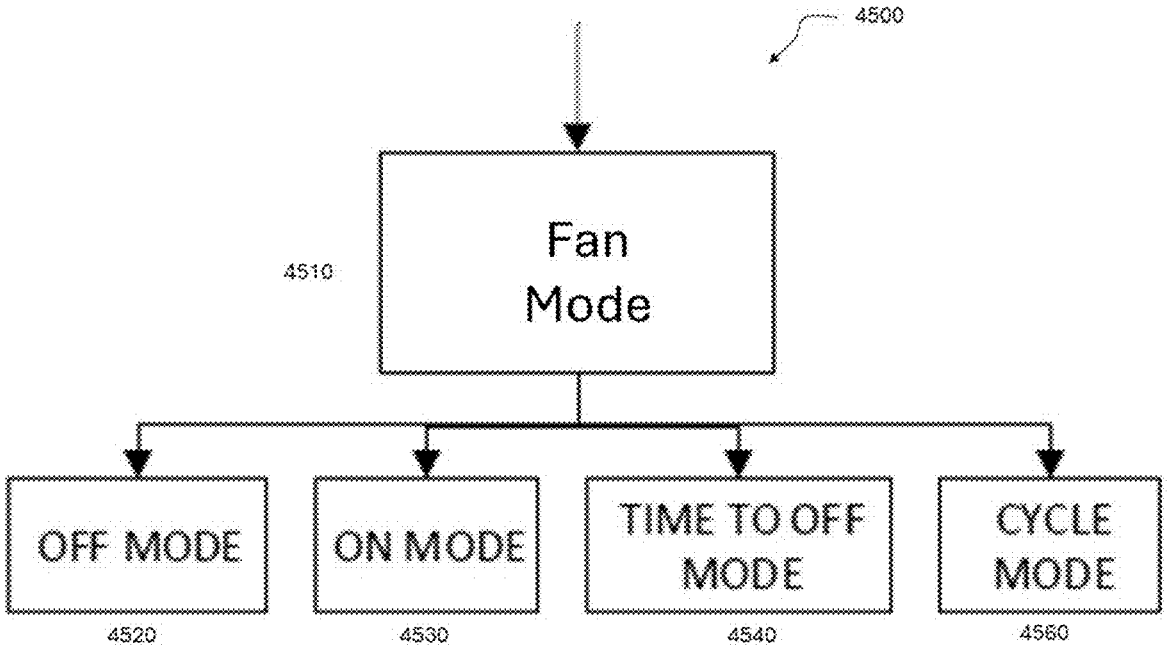
FIG. 4D is a functional flowchart of the fan mode of the air conditioning device with VPD control, according to an embodiment of the invention.

FIG. 4D is a functional flowchart of the fan mode of the air conditioning device with VPD control, according to an embodiment of the invention. When entering the fan mode 4510, there are at least 4 sub-control modes: OFF mode 4520, ON mode 4530, TIMER-TO-OFF mode 4540 and CYCLE mode 4560. According to an embodiment of the invention, when entering the OFF mode 4520, the fan is not running, and under this OFF mode 4520, the minimum fan gear Min Level can be set. The OFF mode 4520 is the running mode when other modes are triggered to be OFF. The OFF mode 4520 is defaulted to fan gear 0.

According to an embodiment of the invention, when entering the ON mode 4530, the fan keeps running, and under the ON mode 4530, the maximum fan gear Max Level can be set. The ON mode 4530 is the running mode when other modes are triggered to be ON. The ON mode ranges from fan gear 0 to gear 10. The ON mode 4530 is defaulted to fan gear 6.

According to an embodiment of the invention, in the TIMER-TO-OFF mode 4540, the default timer is set to be 0:00. When the TIMER is not zero, during the TIMER countdown, Max Level fan gear is run, and when the TIMER counts down to zero, Min Level fan gear is run. When the TIMER is set to zero, then Min Level fan gear is run.

According to an embodiment of the invention, in the CYCLE mode 4560, the default setting is zero. In the CYCLE mode 4560, ON time and OFF time can be set respectively. During the ON time, ON mode is run with Max Level fan gear, while during OFF time, OFF mode is run with Min Level fan gear. When both ON time and OFF time are set to zero, then fan gear 0 is run.

Figure 4E:
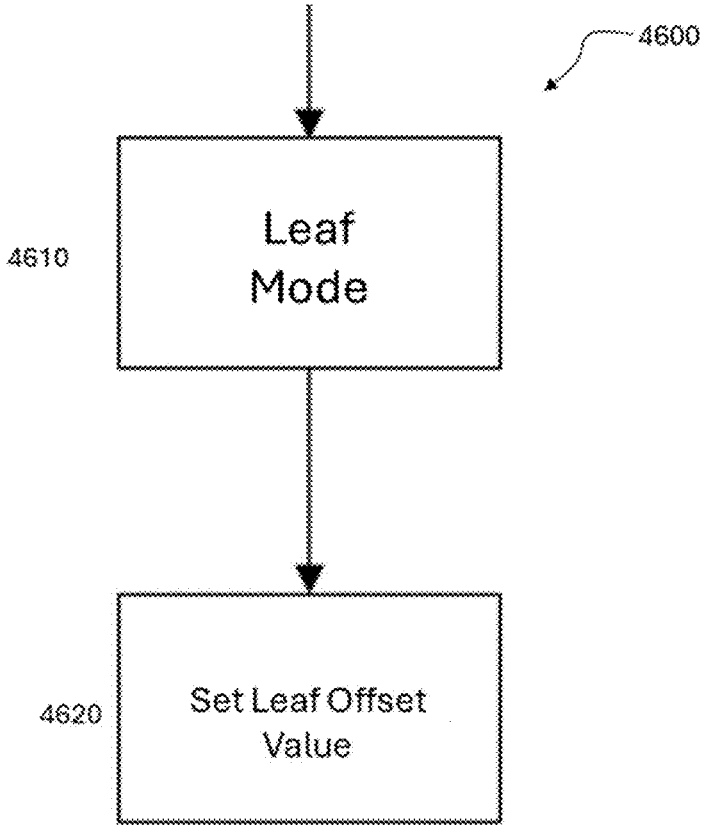
FIG. 4E is a functional flowchart of the leaf mode of the air conditioning device with VPD control, according to an embodiment of the invention.

FIG. 4E is a functional flowchart of the leaf mode of the air conditioning device with VPD control, according to an embodiment of the invention. In this leaf mode 4610, the leaf offset value is set in 4620. The default leaf offset value of is zero, which can be adjusted with increment of 1° C., or 1° F., and the adjustment range is from −20° F. to 20° F., or −10° C. to 10° C. The leaf offset value is used in the calculation of the leaf VPD, as discussed above.

Figure 4F:
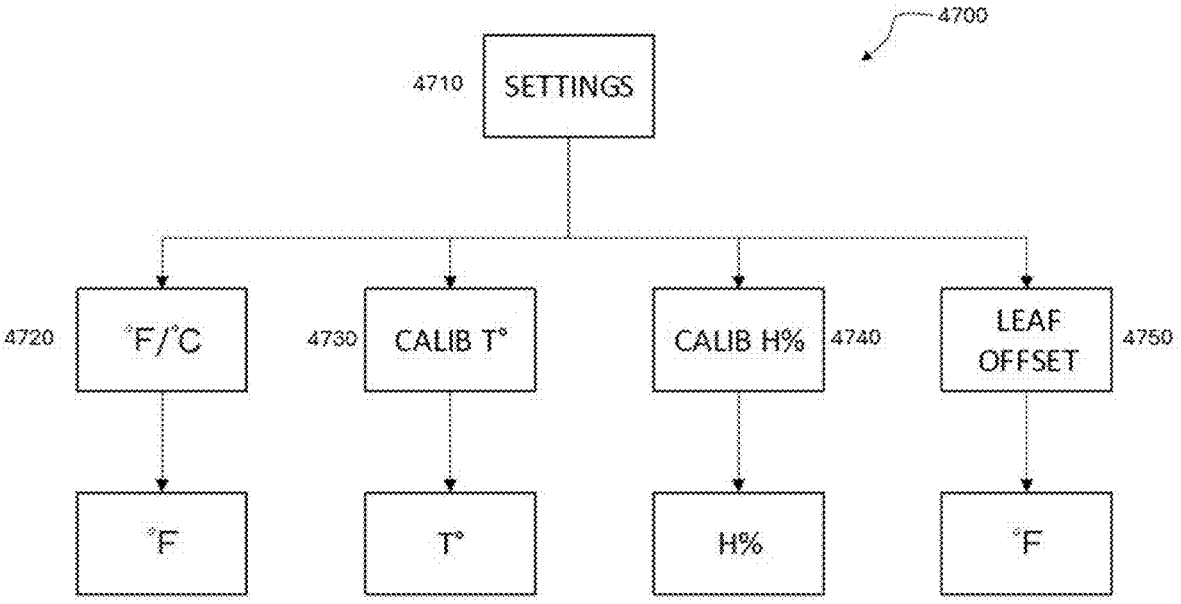
FIG. 4F is a functional flowchart of the setting mode of the air conditioning device with VPD control, according to an embodiment of the invention.

FIG. 4F is a functional flowchart of the setting mode of the air conditioning device with VPD control, according to an embodiment of the invention. In the setting mode 4700, the settings 4710 includes at least 4 setting options: ° F./° C. SETTING 4720, CALIB. T° SETTING 4730, CALIB. H % SETTING 4740, and Leaf Offset 4750. The ° F./° C. SETTING 4720 toggles between temperature units ° F./° C. The CALIB. T° SETTING 4730 calibrates temperature, whose value can be adjusted in the range of −20° F. to 20° F., or −10° C. to 10° C. The CALIB. H % SETTING 4740 calibrates the humidity value, who value can be adjusted within the range of −10% to 10%. The Leaf Offset 4750 is defaulted to 0 and can be incremented with 1° F., or 1° C., whose value can be adjusted in the range of −20° F. to 20° F., or −10° C. to 10° C. The leaf offset value is used in the calculation of the leaf VPD, as discussed above.

FIG. 5 is a view of the air conditioning device with VPD control with air hoods mounted, according to an embodiment of the invention. FIG. 5 is a corresponding perspective view of FIG. 3. In this perspective view, the upper return air hood 1019 and the lower return air hood 1020 are illustrated. When the air conditioning device with VPD control is started, ambient hot air enters through the lower return air hood 1020 and goes out through the hot air outlet, or ambient cold air enters through the upper return air hood 1019 and goes out through the cold air outlet.

FIG. 6 is a view of the air conditioning device with VPD control without air hoods mounted, according to an embodiment of the invention. FIG. 6 is a corresponding perspective view of FIG. 2. In this view, the evaporator screen frame 1021 and the condenser screen frame 1022 are illustrated.

Figure 7:
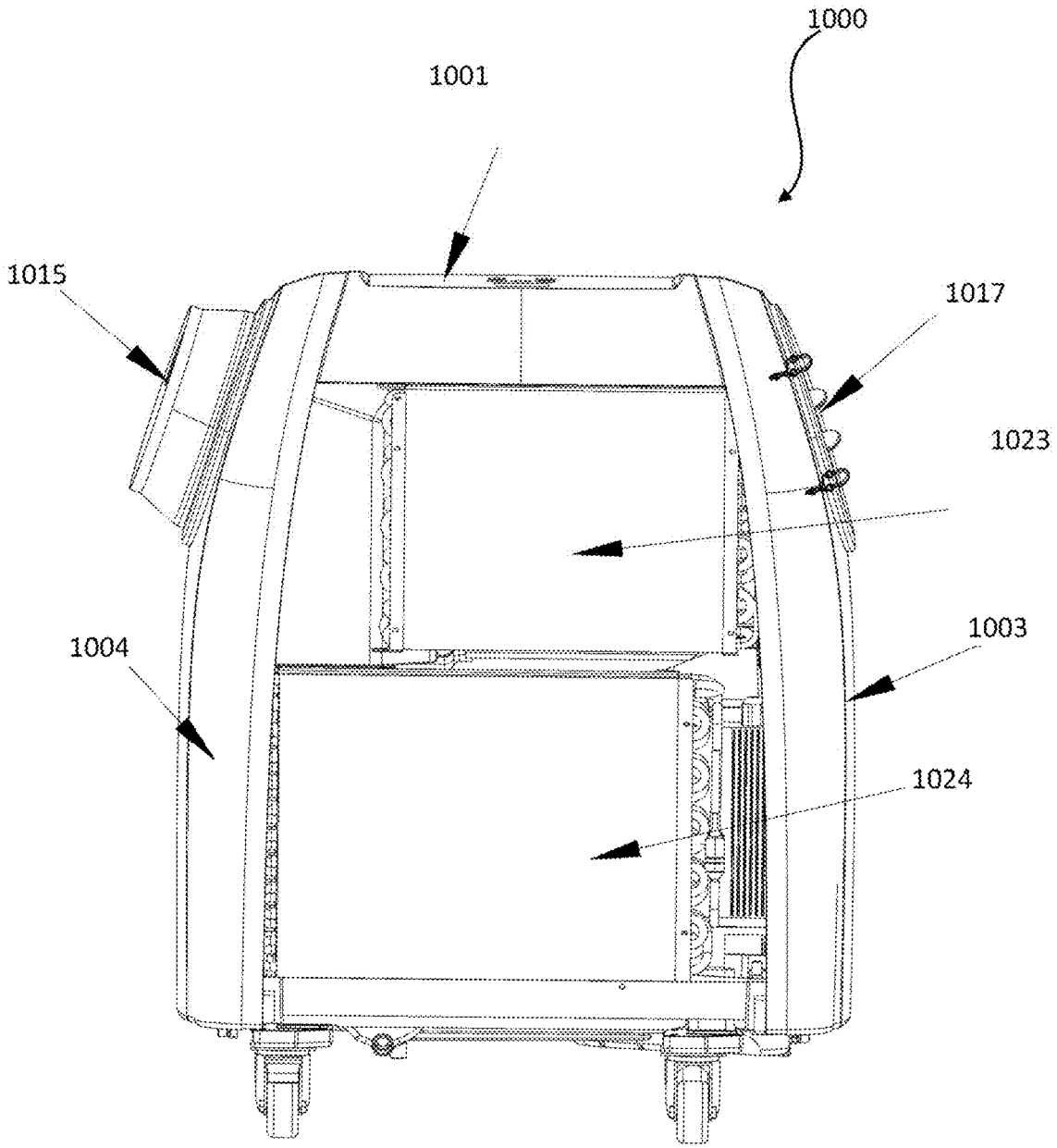
FIG. 7 is a view of the air conditioning device with VPD control with the left-side enclosure wall removed, according to an embodiment of the invention.

FIG. 7 is a view of the air conditioning device with VPD control with the left-side enclosure wall removed, according to an embodiment of the invention. FIG. 7 is another side view of the air conditioning device with VPD control 1000, in which the evaporator 1023 and the condenser 1024 are illustrated.

Figure 8:
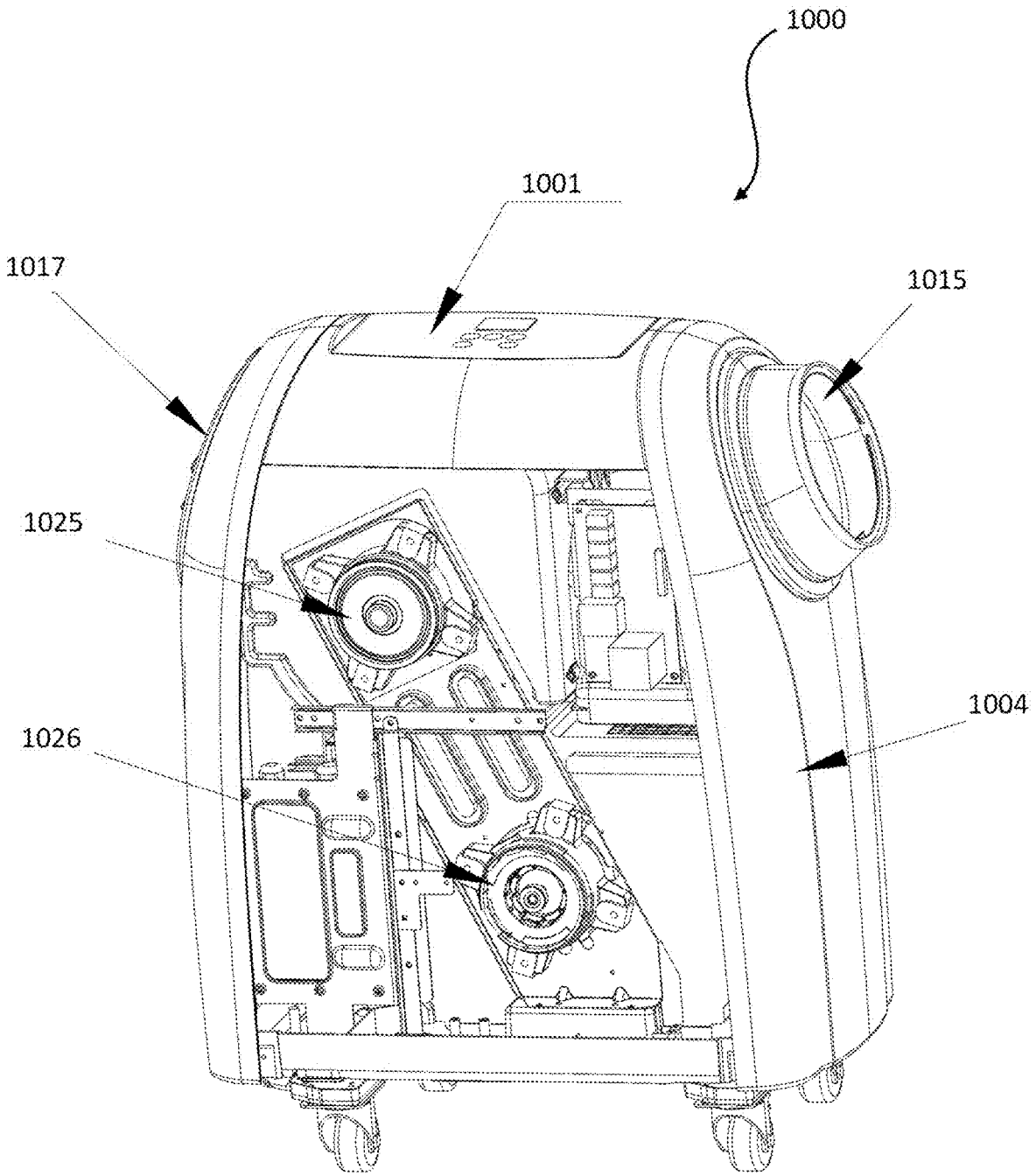
FIG. 8 is a view of the air conditioning device with VPD control with the right-side enclosure wall removed, according to an embodiment of the invention.

FIG. 8 is another view of the air conditioning device with VPD control with the right-side enclosure wall removed, according to an embodiment of the invention. In FIG. 8, the right cover is removed to show structural details inside the enclosure of the air conditioning device with VPD control 1000. In this view, two fan motors 1025 and 1026 are illustrated, which power the corresponding fans of the air conditioning device with VPD control 1000.

Figure 9:
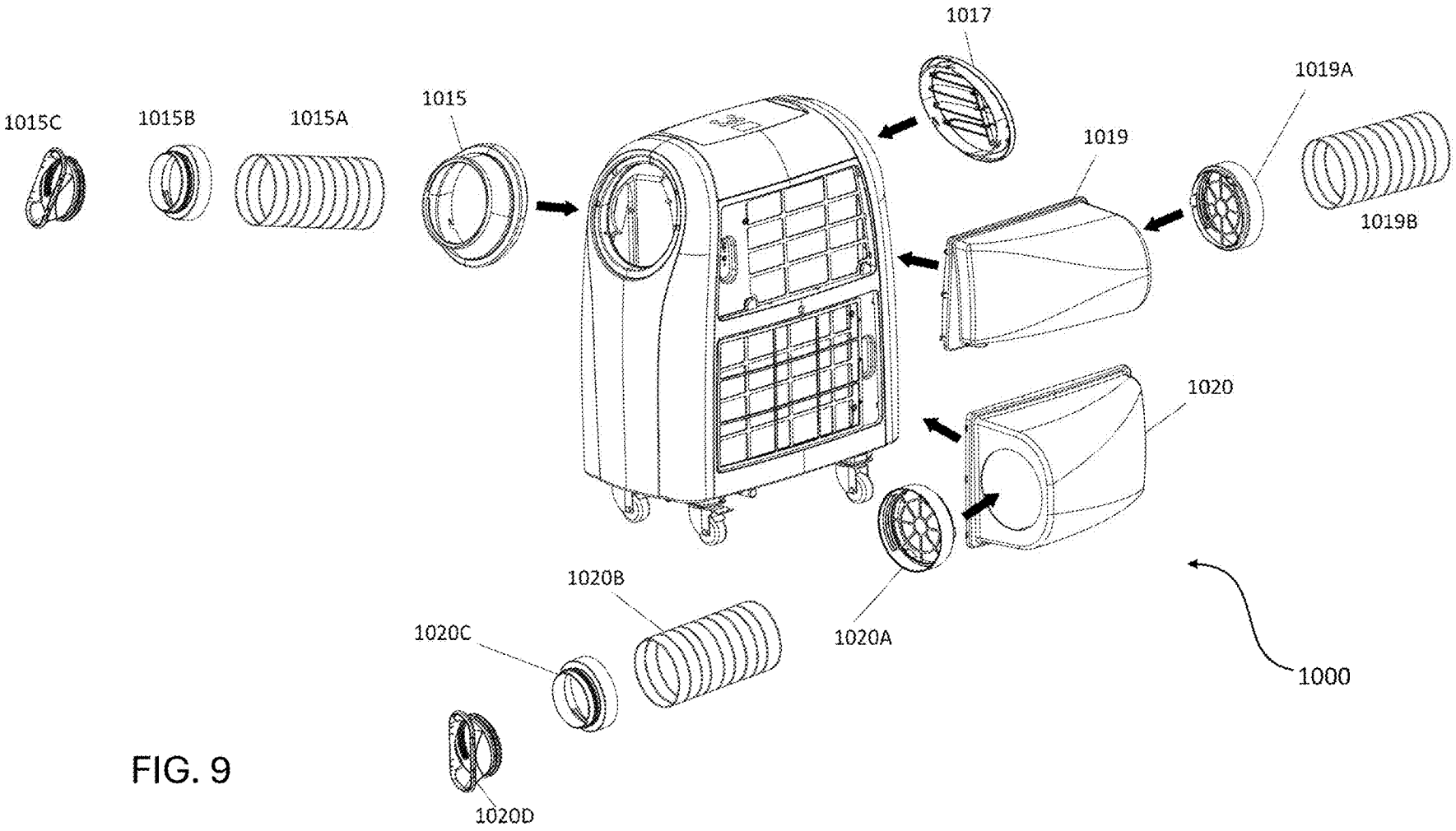
FIG. 9 is another view of the air conditioning device with VPD control, according to an embodiment of the invention.

FIG. 9 is another view of the air conditioning device with VPD control, according to an embodiment of the invention. FIG. 9 illustrates the assembly of air ducts, the upper and lower air return hoods and other corresponding air duct connectors. According to an embodiment of the invention, the upper return air hood 1019 and the lower return air hood 1020 are mounted on a side of the enclosure of the air conditioning device with VPD control 1000, adjacent to the evaporator 1023 and the condenser 1024 correspondingly. The air hoods can be mounted on either side of the enclosure of the air conditioning device with VPD control 1000 adjacent to the evaporator 1023 and the condenser 1024. The upper return air hood 1019 and the lower return air hood 1020 are mounted with corresponding connectors 1019A and 1020A, which are further mounted with corresponding air pipes 1019B and 1020B. The air pipes 1019B and 1020B can be further connected with additional connectors and pipes, for example, the air pipe 1020B is connected with additional connectors 1020C and 1020D for further air flow control. The hot air exit 1015 is further connected to air pipe 1015A, and further connectors 1015B and 10155C for additional air flow control. The cold air exit 1017 can also be replaced with the same connectors and piping as the 1015, 1015A, 1015B, and 1015C. When a VPD-controlled air conditioner is placed in an indoor growing environment, such as a tent, there is no need to install connectors, pipes and air hoods. In order to save planting space and reduce equipment noise, air conditioning equipment with VPD control can be placed outside the planting environment, and gas can be imported or exported into the planting environment through pipes.

Overall, air conditioning device with VPD control, is powered by a 5V DC power supply, which is DC-to-DC converted into 3.3V to power different components of air conditioning device with VPD control. Information display is achieved by the LCD screen. Information input is achieved either by a set of four physical keys, or a touch screen. Two external connectors are implemented, one is a Type-C USB connector to connect to a proprietary external controller specifically designed by the inventor to conduct proprietary tasks such as firmware/software update of the control system. The other connector is an audio jack connector to connect to the external temperature and humidity sensors.

FIG. 10 is a chart illustrating the relationship among VPD, temperature and relative humidity in cannabis cultivation, according to an embodiment of the invention. As illustrated in FIG. 10, in the chart depicting the relationship between temperature, humidity and VPD below, there are five zones: zone 1 through zone 5, with different combinations of temperature and relative humidity values. For example, zone 1: danger zone; zone 2: blue zone for low transpiration stage, propagation stage and early vegetative stage; zone 3: green zone for optimized healthy growth during transpiration stage, late vegetative state, and early flower stage; zone 4: yellow zone for high transpiration stage and late flower stage; zone 5: danger zone. Among these zones, zone 3 is the optimal zone with ideal combinations of temperature and relative humidity value for cannabis plants. For different stages, such as growth and flowering stages, temperature, relative humidity, and the recommended leaf VPD values are listed in the chart in FIG. 10.

The air conditioning device with VPD control as discussed above is a specialty device which has not previously been invented specifically for indoor cannabis cultivation, no air conditioner or similar air conditioner with VPD control as discussed above is on the market as of the day of the filing of this patent application. There exists long-felt market need. The air conditioning device with VPD control as discussed above requires unconventional sensor choices, specialty programming, and modifications to an air conditioner's design to allow it to be integrated into a residential indoor cannabis cultivation space. This long-felt specialty market need is not fulfilled so far by any other designs on the market.

The air conditioning device with VPD control as discussed above requires a redesign of the conventional air conditioner to accept not only the humidity sensor readings, but in addition, it requires it to be able to compute these humidity sensor readings along with the temperature sensor readings to provide an air VPD value. The air conditioner needs to be reprogrammed to be controllable based on the VPD readings instead of just temperature, which is completely novel to the indoor cannabis cultivation air conditioner market. The hardware, firmware, and software all need to be redesigned and redeveloped to accomplish the air conditioning device with VPD control as discussed above, which can also be called a VPD air conditioner for indoor cannabis cultivation, or an air conditioning device with VPD control for indoor cannabis cultivation. The present invention includes several additional unique hardware features added to this specific VPD air conditioner, such as the external sensors, expandable tubing, and air intake fan controls, etc., which are all specifically developed to cater to the indoor residential cannabis cultivation market.

Controlling the environment via VPD that only caters to a specific consumer market, such as the indoor residential cannabis cultivation market, is relatively new. The high cost of setting up an indoor residential cannabis cultivation room or tent has long prevented the market from developing any specialty devices until recently, with the introduction of legalized residential indoor cannabis cultivation across the nation. When combined with the high cost of legally purchasing cannabis, this has led to the rise of consumers looking to start their own residential indoor cannabis cultivation. Financially, with each plant grown having a market value of on average \$200-\$1000, residential growers are now willing to spend much more on specialty indoor grow devices to improve their plant quality as they can often recapture the cost of expensive indoor cultivation equipment within 3-6 months. This has led to a push for better indoor cultivation equipment to be developed.

The present invention is more focused on the indoor residential cultivation market because commercial indoor growers are still using temperature and humidity devices to fine tune their grow environment in lieu of VPD, but residential growers often lacking the tools needed to maintain both a set temperature and humidity, which would require a humidifier, a dehumidifier, an air conditioner, and a heater. By utilizing VPD, residential growers can eliminate at least one or two of these equipment's while still maintaining the same optimal cultivation environment as long as the temperature and humidity of the cultivation space does not reach extreme levels.

Other and various embodiments within the scope of the invention will be readily evident to practitioners skilled in the art, from specification, figures and claims that follow.

What is claimed is:

1. An air conditioning device with VPD control for indoor residential cannabis cultivation, the air conditioning device with VPD control comprising:

a power supply;

a fan driven by a motor, wherein the fan includes a plurality of fan speed gears under a fan mode;

a cooling unit for providing cold air to the air conditioning device with VPD control for indoor residential cannabis cultivation, wherein the air conditioning device includes a plurality of cooling power gears under a cooling mode;

a temperature-humidity sensor for sensing an environmental temperature value $T_{ENV}$ and an environmental relative humidity value $RH_{ENV}$ within an indoor cannabis cultivation environment, wherein a leaf VPD value $VPD_{LEAF}$ is calculated from the environmental temperature value $T_{ENV}$ and the environmental relative humidity value $RH_{ENV}$; and a control module that comprises:

a display screen, an IO interface for input and output of control information and status information;

a control unit for communicating with and controlling the power supply, the fan, the motor, the cooling unit, the IO interface, and the temperature-humidity sensor, wherein, in a cooling mode of the air conditioning device with VPD control, the leaf VPD value $VPD_{LEAF}$ calculated from the environmental temperature value $T_{ENV}$ and the environmental relative humidity value $RH_{ENV}$ is implemented to control the air conditioning device with VPD control for indoor residential cannabis cultivation, wherein in the cooling mode, when the leaf VPD value $VPD_{LEAF}$ is greater than or equal to a predetermined threshold $VPD_{\theta}$, the cooling power gear is increased to a Max-level cooling power gear set in a ON cooling mode, wherein when the leaf VPD value $VPD_{LEAF}$ is lower than the predetermined threshold $VPD_{\theta}$, the cooling power gear is decreased to a Min-level cooling power gear set in a OFF cooling mode.

2. The air conditioning device with VPD control for indoor residential cannabis cultivation of claim 1, wherein the leaf VDP value $VPD_{LEAF}$ is calculated from the environmental temperature value $T_{ENV}$, leaf temperature $T_{LEAF}$ and the environmental relative humidity value $RH_{ENV}$ by:

$$\text{Leaf } VPD = 610.78e^{17.2694\frac{T_{LEAF}}{237.3+T_{LEAF}}} - 610.78e^{17.2694\frac{T_{ENV}}{237.3+T_{ENV}}} \times \frac{RH_{ENV}}{100},$$

wherein, VPD unit is in Pa, $T_{ENV}$ is the temperature of the environment in degrees Celsius, $T_{LEAF}$ is the temperature of the leaf in degrees Celsius, $RH_{ENV}$ is relative humidity of air in % unit and e≈2.71828.

3. The air conditioning device with VPD control for indoor residential cannabis cultivation of claim 2, wherein $T_{LEAF}=T_{ENV}$+Leaf Offset, and wherein when the Leaf Offset is defaulted to 0° C., the leaf VPD value $VPD_{LEAF}$ is calculated from the environmental temperature value $T_{ENV}$ and the environmental relative humidity value $RH_{ENV}$ via:

$$\text{Leaf } VPD = 610.78e^{17.2694\frac{T_{ENV}}{237.3+T_{ENV}}}\left(1 - \frac{RH_{ENV}}{100}\right),$$

wherein, Leaf VPD unit is in Pa, $T_{ENV}$ is temperature of the air in degrees Celsius, $RH_{ENV}$ is relative humidity of air in % unit and e≈2.71828.

4. The air conditioning device with VPD control for indoor residential cannabis cultivation of claim 3, wherein in an AUTO cooling mode, a temperature threshold value is set between 0 and 100 using the IO interface, when the environmental temperature value $T_{ENV}$ is greater than or equal to the temperature threshold value, the cooling power gear is increased gradually to the Max-level cooling power gear set in the ON cooling mode, when the environmental temperature value T is smaller than the temperature threshold value, the cooling power gear is decreased gradually to the Min-level cooling power gear set in the OFF cooling mode.

5. The air conditioning device with VPD control for indoor residential cannabis cultivation of claim 3, wherein in a TIMER cooling mode, a countdown timer is set using the IO interface, wherein when the countdown time is not zero, the Max-level cooling power gear is run, wherein when the countdown time reaches zero, the Min-level cooling power gear is run.

6. The air conditioning device with VPD control for indoor residential cannabis cultivation of claim 3, wherein in a CYCLE cooling mode, an ON-time is set, and an OFF-time is set using the IO interface, wherein during the ON-time, the Max-level cooling power gear is run, wherein during the OFF-time, the Min-level cooling power gear is run.

7. The air conditioning device with VPD control for indoor residential cannabis cultivation of claim 2, wherein the user can set a Leaf Offset value between −10° C. and 10° C.

8. The air conditioning device with VPD control according to claim 1, further comprising:

an enclosure having a top cover, a bottom cover, a front-side enclosure wall, a rear-side enclosure wall, a left-side enclosure wall;

a control panel with the display screen mounted on the top cover;

the control unit is integrated into the control panel with the IO interface for input and output of control information;

wherein the cooling unit includes an evaporator and a condenser, and wherein the fan enclosed is disposed in the enclosure, and is implemented for circulating the air treated by the air conditioning device with VPD control into the indoor residential cannabis cultivation environment in response to a fan control signal from the control unit.

9. The air conditioning device with VPD control of claim 8, further comprises:

an upper air hood mounted on an opening on one of the side enclosure walls for the evaporator; and a lower air hood mounted on an opening on one of the side enclosure walls for the condenser, wherein a first hose is connected to the upper air hood to direct air flow for the evaporator, and wherein a second hose is connected to the lower air hood to direct air flow for the condenser.

10. The air conditioning device with VPD control of claim 8, further comprises:

a hot air outlet and a cold air outlet on the side enclosure walls, wherein when the air conditioning device is started, ambient air enters through the lower air hood and goes out through the hot air outlet, or ambient air enters through the upper air hood and goes out through the cold air outlet.

11. The air conditioning device with VPD control of claim 8, further comprises:

a USB-C connector mounted on the rear cover of the enclosure for connecting an external controller to the control module in the enclosure for additional controls.

12. The air conditioning device with VPD control of claim 8, further comprises:

an audio headphone jack mounted on the rear cover of the enclosure for connecting to the temperature-humidity sensor outside the enclosure.

13. The air conditioning device with VPD control of claim 8, further comprises:

an evaporator screen frame and a condenser screen frame.

14. The air conditioning device with VPD control of claim 8, further comprises:

air louvers on at least one of the openings implemented on the side enclosure walls.

* * * * *